US009773503B2

(12) United States Patent
Neuendorf et al.

(10) Patent No.: US 9,773,503 B2
(45) Date of Patent: Sep. 26, 2017

(54) AUDIO ENCODER AND DECODER HAVING A FLEXIBLE CONFIGURATION FUNCTIONALITY

(71) Applicants: Fraunhofer-Gesellschaft zur Foerderung der angewandten Forschung e.V., Munich (DE); Dolby International AB, Amsterdam Zuid-Oost (NL); Koninklijke Philips N.V., Eindhoven (NL)

(72) Inventors: Max Neuendorf, Nuremberg (DE); Markus Multrus, Nuremberg (DE); Stefan Doehla, Erlangen (DE); Heiko Purnhagen, Sundbyberg (SE); Frans De Bont, Riethoven (NL)

(73) Assignees: FRAUNHOFER-GESELLSCHAFT ZUR FOERDERUNG DER ANGEWANDTEN FORSCHUNG E.V., Munich (DE); DOLBY INTERNATIONAL AB, Amsterdam (NL); KONINKLIJKE PHILIPS N.V., Eindhoven (NL)

( * ) Notice: Subject to any disclaimer, the term of this patent is extended or adjusted under 35 U.S.C. 154(b) by 654 days.

(21) Appl. No.: 14/029,054

(22) Filed: Sep. 17, 2013

(65) Prior Publication Data

US 2014/0016785 A1 Jan. 16, 2014

Related U.S. Application Data

(63) Continuation of application No. PCT/EP2012/054749, filed on Mar. 19, 2012.
(Continued)

(51) Int. Cl.
*G10L 19/008* (2013.01)
*G10L 19/16* (2013.01)
(Continued)

(52) U.S. Cl.
CPC ..... *G10L 19/008* (2013.01); *G10L 19/00* (2013.01); *G10L 19/167* (2013.01); *G10L 19/18* (2013.01)

(58) Field of Classification Search
CPC combination set(s) only.
See application file for complete search history.

(56) References Cited

U.S. PATENT DOCUMENTS 6,256,487 B1 7/2001 Bruhn
7,860,709 B2 12/2010 Mäkinen
(Continued)

FOREIGN PATENT DOCUMENTS

CN 1711587 A 12/2005
CN 1761308 A 4/2006
(Continued)

OTHER PUBLICATIONS

Offical Communication issued in corresponding Japanese Patent Application No. 2013-558468, dated Sep. 2, 2014.
(Continued)

*Primary Examiner* — Duc Nguyen
*Assistant Examiner* — Assad Mohammed
(74) *Attorney, Agent, or Firm* — Keating & Bennett, LLP

(57) ABSTRACT

An audio decoder for decoding an encoded audio signal, the encoded audio signal including a first channel element and a second channel element in a payload section of a data stream and first decoder configuration data for the first channel element and second decoder configuration data for the second channel element in a configuration section of the data stream, includes: a data stream reader for reading the configuration data for each channel element in the configuration section and for reading the payload data for each channel element in the payload section; a configurable decoder for decoding the plurality of channel elements; and
(Continued)

a configuration controller for configuring the configurable decoder so that the configurable decoder is configured in accordance with the first decoder configuration data when decoding the first channel element and in accordance with the second decoder configuration data when decoding the second channel element.

18 Claims, 22 Drawing Sheets

Related U.S. Application Data

(60) Provisional application No. 61/454,121, filed on Mar. 18, 2011.

(51) Int. Cl.
*G10L 19/18* (2013.01)
*G10L 19/00* (2013.01)

(56) References Cited

U.S. PATENT DOCUMENTS

| | | | | |
|---|---|---|---|---|
| 7,873,227 | B2 | 1/2011 | Geiger et al. | |
| 7,916,873 | B2 * | 3/2011 | Villemoes | G10L 19/008 381/22 |
| 8,731,204 | B2 | 5/2014 | Sperschneider et al. | |
| 2003/0125933 | A1 * | 7/2003 | Saunders | G09B 5/04 704/201 |
| 2004/0093207 | A1 | 5/2004 | Ashley et al. | |
| 2004/0193430 | A1 | 9/2004 | Heo et al. | |
| 2005/0074127 | A1 * | 4/2005 | Herre | G10L 19/008 381/20 |
| 2005/0185850 | A1 | 8/2005 | Vinton et al. | |
| 2005/0286657 | A1 * | 12/2005 | Thyssen | H04L 1/0045 375/340 |
| 2006/0174267 | A1 * | 8/2006 | Schmidt | H04S 1/007 725/39 |
| 2007/0009033 | A1 | 1/2007 | Liebchen | |
| 2007/0206690 | A1 | 9/2007 | Sperschneider et al. | |
| 2008/0013614 | A1 | 1/2008 | Fiesel et al. | |
| 2009/0216541 | A1 * | 8/2009 | Oh | G10L 19/008 704/500 |
| 2009/0240504 | A1 | 9/2009 | Pang et al. | |
| 2010/0106802 | A1 | 4/2010 | Zink et al. | |
| 2010/0153097 | A1 | 6/2010 | Hotho et al. | |
| 2010/0174548 | A1 | 7/2010 | Beack et al. | |
| 2011/0153333 | A1 | 6/2011 | Bessette | |
| 2011/0170711 | A1 | 7/2011 | Rettelbach et al. | |
| 2011/0173007 | A1 | 7/2011 | Multrus et al. | |
| 2011/0202353 | A1 | 8/2011 | Neuendorf et al. | |
| 2011/0238426 | A1 | 9/2011 | Fuchs et al. | |
| 2011/0320196 | A1 | 12/2011 | Choo et al. | |
| 2012/0022881 | A1 | 1/2012 | Geiger et al. | |
| 2012/0065753 | A1 | 3/2012 | Choo et al. | |
| 2012/0130721 | A1 | 5/2012 | Sirivara et al. | |

FOREIGN PATENT DOCUMENTS

| | | | |
|---|---|---|---|
| CN | 101189661 | A | 5/2008 |
| CN | 101529503 | A | 9/2009 |
| EP | 2 182 513 | A1 | 5/2010 |
| EP | 2 242 048 | A2 | 10/2010 |
| EP | 2 273 492 | A2 | 1/2011 |
| EP | 2 373 014 | A2 | 10/2011 |
| JP | 9-146596 | A | 6/1997 |
| JP | 2008-512708 | A | 4/2008 |
| JP | 2008-542815 | A | 11/2008 |
| JP | 2012-503791 | A | 2/2012 |
| JP | 2012-503792 | A | 2/2012 |
| KR | 10-2008-0029940 | A | 4/2008 |
| KR | 10-2008-0059156 | A | 6/2008 |
| KR | 10-2009-0004778 | A | 1/2009 |
| KR | 10-2009-0104674 | A | 10/2009 |
| RU | 2 239 950 | C2 | 11/2004 |
| RU | 2 380 767 | C2 | 1/2010 |
| RU | 2 411 594 | C2 | 2/2011 |
| TW | I1231471 | B | 12/1992 |
| TW | 201007698 | A1 | 2/2010 |
| TW | 201009808 | A1 | 3/2010 |
| TW | 201030735 | A1 | 8/2010 |
| TW | 201032218 | A1 | 9/2010 |
| WO | 2006/102991 | A1 | 10/2006 |
| WO | 2006/126855 | A2 | 11/2006 |
| WO | 2008/046530 | A2 | 4/2008 |
| WO | 2008/067764 | A1 | 6/2008 |
| WO | 2008/098645 | A2 | 8/2008 |
| WO | 2010/003556 | A1 | 1/2010 |
| WO | 2010/003582 | A1 | 1/2010 |
| WO | 2010/003583 | A1 | 1/2010 |
| WO | 2010003581 | A1 | 1/2010 |
| WO | 2010/036059 | A2 | 4/2010 |
| WO | 2010/036062 | A2 | 4/2010 |
| WO | 2010/062123 | A2 | 6/2010 |
| WO | 2010/086373 | A2 | 8/2010 |
| WO | 2010/087614 | A2 | 8/2010 |
| WO | 2010/090427 | A2 | 8/2010 |
| WO | 2010/148516 | A1 | 12/2010 |
| WO | 2011/010876 | A2 | 1/2011 |

OTHER PUBLICATIONS

Official Communication issued in correspding Japanese Patent Application No. 2013-558472, dated Sep. 30, 2014.

Purnhagen, Heiko et al.; "Technical Description of Proposed Unified Stereo Coding in USAC," ISO/IEC, JTC1/SC29/WG11, Oct. 2009, MPEG2009/M16921, pp. 1-14.

Neuendorf, Max; "WD5 of USAC"; ISO/IEC; JTC1/SC29/WG11; Oct. 2009; MPEG2009/N11040; pp. 1-146.

Purnhagen, Heiko et al.; "Technical Description of CE on Improved Stero Coding in USAC"; ISO/IEC, JTC1/SC29/WG11; Jul. 2010; MPEG2010/M17825; pp. 1-22.

Haus, G., "3.6 AES3-1992 (ANSI S4.40/1992) 'AES-EBU", IEEE Computer Society Press., 1995, pp. 1-15.

Official Communication issued in corresponding Russian Patent Application No. 2013146526, dated Sep. 7, 2015.

Official Communication issued in corresponding Russian Patent Application No. 2013146528, dated Jun. 24, 2015.

Official Communication issued in corresponding Korean Patent Application No. 10-2013-7027429, dated Apr. 13, 2015.

Official Communication issued in corresponding Korean Patent Application No. 10-2013-7027430, dated Apr. 16, 2015.

Official Communication issued in corresponding Korean Patent Application No. 10-2013-7027431, dated Apr. 16, 2015.

ISO/IEC FDIS 23003-3 "Information Technology—MPEG Audio Technologies—Part 3: Unified Speech and Audio Coding"; International Standards Organization, 2011.

ISO/IEC 14496-3; "Information Technology—Coding of Audio-Visual Objects—Part 3: Audio"; International Standards Organization, 2009.

ISO/IEC JTC 1/SC 29 N 11510; WG11, Information Technology—MPEG Audio Technologies—Part 3: Unified Speech and Audio Coding, International Standards Organization; Sep. 24, 2010.

ISO/IEC JTC 1/SC 29; ISO/IEC FDIS 23003-1 "Information Technology—MPEG Audio Technologies—Part 1: MPEG Surround"; International Standards Organization, Jul. 21, 2006.

ISO/IEC 23003-2 Information Technology—MPEG Audio Technologies—Part 2: Spatial Audio Object Coding (SAOC) International Standards Organization, Oct. 1, 2010.

ISO/IEC 14496-1; "Information Technology—Coding of Audio-Visual Objects—Part 1: Systems"; International Standards Organization, Nov. 15, 2004.

Neuendorf, M., et al.; "Follow-Up on Proposed Revision of USAC Bit Stream Syntax"; ISO/IEC JTC1/SC29/WG11; M20069; MPEG Meeting; Mar. 2011.

Neuendorf, M., et al.; "Proposed Revision of USAC Bit Stream Syntax Addressing USAC Design Considerations"; ISO/IEC JTC1/SC29/WG11, M19337; MPEG Meeting; Jan. 2011.

(56) References Cited

OTHER PUBLICATIONS

Anonymous; "Study on ISO/IEC 23003-3:201x/DIS of Unified Speech and Audio Coding" ISO/IEC JTC1/SC29/WG11, N12013, MPEG Meeting; Mar. 2011.
English translation of Official Communication issued in corresponding Chinese Patent Application No. 201280023577.3, dated Nov. 2, 2014.
English Translation Official Communication issued in corresponding Chinese Patent Application No. 201280023547.2, dated Jun. 30, 2015.
Neuendorf et al.; "Frame Element Length Transmission in Audio Coding"; U.S. Appl. No. 14/029,073, filed Sep. 17, 2013.
Neuendorf et al.; "Frame Element Positioning in Frames of a Bitstream Representing Audio Content"; U.S. Appl. No. 14/029,028, filed Sep. 17, 2013.
Official Communication issued in corresponding Russian Patent Application No. 2013146530, dated Apr. 12, 2016.
Official Communication issued in corresponding Korean Patent Application No. 10-2016-7012032, dated Apr. 20, 2017
Neuendorf et al., "Frame Element Positioning in Frames of a Bitstream Representing Audio Content", U.S. Appl. No. 15/613,484, filed Jun. 5, 2017.

* cited by examiner (DECODER)

(ENCODER)

Table - Channel Configurations,
meaning of channelConfigurationIndex,
mapping of channel elements to loudspeaker positions

| va-lue | audio syntactic elements, listed in order received | channel to speaker mapping | speaker abbrev. | „Front/ Surr. LFE“ notation |
|---|---|---|---|---|
| 0 | - | defined in UsacChannelConfig() | - | - |
| 1 | UsacSingleChannelElement() | center front speaker | C | 1/0.0 |
| 2 | UsacChannelPairElement() | left, right front speakers | L, R | 2/0.0 |
| 3 | UsacSingleChannelElement(),<br>UsacChannelPairElement() | center front speaker,<br>left, right front speakers | C<br>L,R | 3/0.0 |
| 4 | UsacSingleChannelElement(),<br>UsacChannelPairElement(),<br>UsacSingleChannelElement() | center front speaker,<br>left, right center front speakers,<br>center rear speakers | C<br>L, R<br>Cs | 3/1.0 |
| 5 | UsacSingleChannelElement(),<br>UsacChannelPairElement(),<br>UsacChannelPairElement() | center front speaker,<br>left, right front speakers,<br>left surround, right sorround speakers | C<br>L,R<br>Ls, Rs | 3/2.0 |
| 6 | UsacSingleChannelElement(),<br>UsacChannelPairElement(),<br>UsacChannelPairElement(),<br>UsacLfeElement() | center front speaker,<br>left, right front speakers,<br>left surround, right sorround speakers,<br>center front LFE speaker | C<br>L, R<br>Ls, Rs<br>LFE | 3/2.1 |
| 7 | UsacSingleChannelElement(),<br>UsacChannelPairElement(),<br>UsacChannelPairElement(),<br>UsacChannelPairElement(),<br>UsacLfeElement() | center front speaker,<br>left, right center front speakers,<br>left, right outside front speakers,<br>left surround, right sorround speakers,<br>center front LFE speaker | C<br>Lc, Rc<br>L, R<br>Ls, Rs<br>LFE | 5/2.1 |
| 8 | UsacSingleChannelElement(),<br>UsacSingleChannelElement() | channel1<br>channel2 | N.A.<br>N.A. | 1+1 |
| 9 | UsacChannelPairElement(),<br>UsacSingleChannelElement() | left, right front speakers,<br>center rear speaker | L, R<br>Cs | 2/1.0 |
| 10 | UsacChannelPairElement(),<br>UsacChannelPairElement() | left, right front speaker,<br>left, right rear speakers | L, R<br>Ls, Rs | 2/2.0 |
| 11 | UsacSingleChannelElement(),<br>UsacChannelPairElement(),<br>UsacChannelPairElement(),<br>UsacSingleChannelElement(),<br>UsacLfeElement() | center front speaker,<br>left, right front speakers,<br>left surround, right sorround speakers,<br>center rear speaker,<br>center front LFE speaker | C<br>L, R<br>Ls, Rs<br>Cs<br>LFE | 3/3.1 |
| 12 | UsacSingleChannelElement(),<br>UsacChannelPairElement(),<br>UsacChannelPairElement(),<br>UsacChannelPairElement(),<br>UsacLfeElement() | center front speaker,<br>left, right front speakers,<br>left surround, right sorround speakers,<br>left, right rear speakers,<br>center front LFE speaker | C<br>L, R<br>Ls, Rs<br>Lsr, Rsr<br>LFE | 3/4.1 |

FIG 3A

| | | | | |
|---|---|---|---|---|
| 13 | UsacSingleChannelElement(),<br>UsacChannelPairElement(),<br>UsacChannelPairElement(),<br>UsacChannelPairElement(),<br>UsacChannelPairElement(),<br>UsacSingleChannelElement(),<br>UsacLfeElement(),<br>UsacLfeElement(),<br>UsacSingleChannelElement(),<br>UsacChannelPairElement(),<br>UsacChannelPairElement(),<br>UsacSingleChannelElement(),<br>UsacChannelPairElement(),<br>UsacSingleChannelElement(),<br>UsacSingleChannelElement(),<br>UsacChannelPairElement() | center front speaker,<br>left, right front speakers,<br>left, right outside front speakers,<br>left, right side speakers,<br>left, right back speakers,<br>back center speaker,<br>left front low freq. effects speaker,<br>right front low freq. effects speaker,<br>top center front speaker,<br>top left, right front speakers,<br>top left, right side speakers,<br>center of the room ceiling speaker,<br>top left, right back speakers,<br>top center back speaker,<br>bottom center front speaker,<br>bottom left, right front speakers | C<br>Lc, Rc<br>L, R<br>Lss, Rss<br>Lsr, Rsr<br>Cs<br>LFE<br>LFE2<br>Cv<br>Lv, Rv<br>Lvss, Rvss<br>Ts<br>Lvr, Rvr<br>Cvr<br>Cb<br>Lb, Rb | 11/11.2 |
| 14 - 31 | reserved | reserved | reserved | |
| NOTE: The values of **channelConfigurationIndex** 1 up to 7 are identical to those of the **channelConfiguration** 1 up to 7 contained in the MPEG-4 AudioSpecificConfig(). | | | | |

FIG 3B bsOutputChannelPos This index describes loudspeaker positions which are associated to a given channel according to FIG 3. FIG 4 indicates the loudspeaker position in the 3D environment of the listener. In order to ease the understanding of loudspeaker positions FIG 4A also contains loudspeaker positions according to IEC 100/1706/CDV which are listed here for information to the interested reader.

Table - bsOutputChannelPos

| bsOutput-Channel-Pos | Loudspeaker position | | Loudspeaker position according to IEC 100/1706/CDV IEC 62574 (TC100) | |
|---|---|---|---|---|
| | Abbr. | | Abbr. | Name |
| 0 | L | Left Front | FL | Front Left |
| 1 | R | Right Front | FR | Front Right |
| 2 | C | Center Front | FC | Front Center |
| 3 | LFE | LowFrequencyEnhancement | LFE1 | LowFrequency Effects-1 |
| 4 | Ls | Left Surround | LS | Left Surround |
| 5 | Rs | Right Surround | RS | Right Surround |
| 6 | Lc | Left Front Center | FLc | Front Left centre |
| 7 | Rc | Right Front Center | FRc | Front Right centre |
| 8 | Lsr | Rear Surround Left | BL | Back Left |
| 9 | Rsr | Rear Surround Right | BR | Back Right |
| 10 | Cs | Rear Center | BC | Back Centre |
| 11 | Lsd | Left Surround Direct | LSd | Left Surround direct |
| 12 | Rsd | Right Surround Direct | RSd | Right Surround direct |
| 13 | Lss | Left Side Surround | SL | Side Left |
| 14 | Rss | Right Side Surround | SR | Side Right |
| 15 | Lw | Left Wide Front | FLw | Front Left wide |
| 16 | Rw | Right Wide Front | FRw | Front Right wide |
| 17 | Lv | Left Front Vertical Height | TpFL | Top Front Left |
| 18 | Rv | Right Front Vertical Height | TpFR | Top Front Right |
| 19 | Cv | Center Front Vertical Height | TpFC | Top Front Centre |
| 20 | Lvr | Left Surround Vertical Height Rear | TpBL | Top Back Left |
| 21 | Rvr | Right Surround Vertical Height Rear | TpBR | Top Back Right |
| 22 | Cvr | Center Vertical Height Rear | TpBC | Top Back Centre |
| 23 | Lvss | Left Vertical Height Side Surround | TpSiL | Top Side Left |
| 24 | Rvss | Right Vertical Height Side Surround | TpSiR | Top Side Right |
| 25 | Ts | Top Center Surround | TpC | Top Centre |
| 26 | LFE2 | Low Frequency Enhancement 2 | LFE2 | Low Frequency Effects-2 |
| 27 | Lb | Left Front Vertical Bottom | BtFL | Bottom Front Left |
| 28 | Rb | Right Front Vertical Bottom | BtFR | Bottom Front Right |
| 29 | Cb | Center Front Vertical Bottom | BtFC | Bottom Front Centre |
| 30 | Lvs | Left Vertical Height Surround | TpLS | Top Left Surround |
| 31 | Rvs | Right Vertical Height Surround | TpRS | Top Right Surround |

FIG 4A loudspeaker positions

- order of configuration data in configuration section is the same as order of the channel element payload data in each frame
- config. sections in data stream provide access points for a stream; for a single file: a single configuration section for all frames is sufficient Syntax of UsacConfig()

| Syntax | No. of bits | Mnemonic |
|---|---|---|
| UsacConfig() | | |
| { | | |
| **usacSamplingFrequencyIndex;** | **5** | **bslbf** |
| if ( usacSamplingFrequecyIndex == 0x1f ) { | | |
| **usacSamplingFrequency;** | **24** | **uimsbf** |
| } | | |
| **coreSbrFrameLenghtIndex;** | **3** | **uimsbf** |
| **channelConfigurationIndex;** | **5** | **uimsbf** |
| if (channelConfigurationIndex ==0) { | | |
| UsacChannelConfig(); | | |
| } | | |
| UsacDecoderConfig(); | | |
| if (**usacConfigExtensionPresent**==1){ | **1** | **uimsbf** |
| UsacConfigExtension(); | | |
| } | | |
| } | | |

FIG 6A

Syntax of UsacChannelConfig()

| Syntax | No. of bits | Mnemonic |
|---|---|---|
| UsacChannelConfig() | | |
| { | | |
| numOutChannels = escapedValue(5,8,16); | | |
| for (i=0; i<numOutChannels; i++) { | | |
| **bsOutputChannelPos[i];** | **5** | **uimsbf** |
| } | | |
| } | | |

FIG 6B

Syntax of UsacDecoderConfig()

| Syntax | No. of bits | Mnemonic |
|---|---|---|
| UsacDecoderConfig() | | |
| { | | |
| numElements = escapedValue(4,8,16) + 1; | | |
| | | |
| for (elemIdx=0; elemIdx<numElements; ++elemIdx) { | | |
| **usacElementType**[elemIdx] | **2** | **uimsbf** |
| switch (usacElementType[elemIdx]) { | | |
| case: ID_USAC_SCE | | |
| UsacSingleChannelElementConfig(sbrRatioIndex); | | |
| break; | | |
| case: ID_USAC_CPE | | |
| UsacChannelPairElementConfig(sbrRatioIndex); | | |
| break; | | |
| case: ID_USAC_LFE | | |
| UsacLfeElementConfig(); | | |
| break; | | |
| case: ID_USAC_EXT | | |
| UsacExtElementConfig(); | | |
| break; | | |
| } | | |
| } | | |

NOTE: UsacSingleChannelElementConfig(), UsacChannelPairElementConfig(), UsacLfeElement-Config() and UsacExtElementConfig() signaled at position elemIdx refer to the corresponding elements in UsacFrame() at the respective position elemIdx.

FIG 6C

Syntax of UsacSingleChannelElementConfig()

| Syntax | No. of bits | Mnemonic |
|---|---|---|
| UsacSingleChannelElementConfig(sbrRatioIndex) | | |
| { | | |
| UsacCoreConfig(); | | |
| if (sbrRatioIndex > 0) { | | |
| SbrConfig(); | | |
| } | | |
| } | | |

FIG 6D

Syntax of UsacChannelPairElementConfig()

| Syntax | No. of bits | Mnemonic |
|---|---|---|
| UsacChannelPairElementConfig(sbrRatioIndex) | | |
| { | | |
| UsacCoreConfig(); | | |
| if (sbrRatioIndex > 0) { | | |
| SbrConfig(); | | |
| **stereoConfigIndex;** | **2** | **uimsbf** |
| } | | |
| else { | | |
| stereoConfigIndex = 0; | | |
| } | | |
| if (stereoConfigIndex > 0) { | | |
| Mps212Config(stereoConfigIndex); | | |
| } | | |
| } | | |

FIG 6E

Syntax of UsacLfeElementConfig()

| Syntax | No. of bits | Mnemonic |
|---|---|---|
| UsacLfeElementConfig() | | |
| { | | |
| tw_mdct = 0; | | |
| noiseFilling = 0; | | |
| } | | |

FIG 6F

Syntax of UsacCoreConfig()

| Syntax | No. of bits | Mnemonic |
|---|---|---|
| UsacCoreConfig() | | |
| { | | |
| tw_mdct; | 1 | bslbf |
| noiseFilling; | 1 | bsblf |
| } | | |

FIG 6G

Syntax of SbrConfig()

| Syntax | No. of bits | Mnemonic |
|---|---|---|
| SbrConfig() | | |
| { | | |
| harmonicsSBR; | 1 | bsblf |
| bs_interTes; | 1 | bsblf |
| bs_pvc; | 1 | bsblf |
| SbrDfltHeader(); | | |
| } | | |

FIG 6H

Syntax of SbrDfltHeader()

| Syntax | No. of bits | Mnemonic |
|---|---|---|
| SbrDfltHeader() | | |
| { | | |
| dflt_start_freq; | 4 | uimsbf |
| dflt_stop_freq; | 4 | uimsbf |
| dflt_header_extra1; | 1 | uimsbf |
| dflt_header_extra2; | 1 | uimsbf |
| if (dflt_header_extra1 ==1) { | | |
| dflt_freq_scale; | 2 | uimsbf |
| dflt_alter_scale; | 1 | uimsbf |
| dflt_noise_bands; | 2 | uimsbf |
| } | | |
| if (dflt_header_extra2 ==1) { | | |
| dflt_limiter_bands; | 2 | uimsbf |
| dflt_limiter_gains; | 2 | uimsbf |
| dflt_interpol_freq; | 1 | uimsbf |
| dflt_smoothing_mode; | 1 | uimsbf |
| } | | |
| } | | |

FIG 6I

Syntax of Mps212Config()

| Syntax | No. of bits | Mnemonic |
|---|---|---|
| Mps212Config(stereoConfigIndex) | | |
| { | | |
| **bsFreqRes;** | 3 | uimsbf |
| **bsFixedGainDMX;** | 3 | uimsbf |
| **bsTempShapeConfig;** | 2 | uimsbf |
| **bsDecorrConfig;** | 2 | uimsbf |
| **bsHighRateMode;** | 1 | uimsbf |
| **bsPhaseCoding;** | 1 | uimsbf |
| **bsOttBandsPhasePresent;** | 1 | uimsbf |
| if (bsOttBandsPhasePresent) { | | NOTE 1 |
| **bsOttBandsPhase;** | 5 | uimsbf |
| } | | |
| if (bsResidualCoding) { | | NOTE 2 |
| **bsResidualBands;** | 5 | uimsbf |
| bsOttBandsPhase = max(bsOttBandsPhase,bsResidualBands); | | |
| **bsPseudoLr;** | 1 | uimsbf |
| } | | |
| if (bsTempShapeConfig ==2) { | | |
| **bsEnvQuantMode;** | 1 | uimsbf |
| } | | |
| } | | |

NOTE 1: if bsOttBandsPhasePresent==0 bsOttBandsPhase ist initialized according to Table 104.
NOTE 2: bsResidualCoding depends on stereoConfigIndex according to Table 72.

FIG 6J

Syntax of UsacExtElementConfig()

| Syntax | No. of bits | Mnemonic |
|---|---|---|
| UsacExtElementConfig() | | |
| { | | |
| usacExtElementType = escapedValue(4,8,16); | | |
| usacExtElementConfigLenght = escapedValue(4,8,16); | | |
| **usacExtElementDefaultLenghtPresent;** | **1** | **uimsbf** |
| if (usacExtElementDefaultLenghtPresent) { | | |
| usacExtElementDefaultLenght = escapedValue(8,16,0) +1; | | |
| } else { | | |
| usacExtElementDefaultLenght = 0; | | |
| } | | |
| **usacExtElementPayloadFrag;** | **1** | **uimsbf** |
| switch (usacExtElementType) { | | |
| case ID_EXT_ELE_FILL: | | |
| break; | | |
| case ID_EXT_ELE_MPEGS: | | |
| SpatialSpecificConfig(); | | |
| break; | | |
| case ID_EXT_ELE_SAOC: | | |
| SaocSpecificConfig(); | | |
| break; | | |
| default: | NOTE | |
| while (usacExtElementConfigLenght--) { | | |
| **tmp;** | **8** | **uimsbf** |
| } | | |
| break; | | |
| } | | |
| } | | |

NOTE: The default entry for the usacExtElementType is used for unknown extElementTypes so that legacy decoders can cope with future extensions.

FIG 6K

Syntax of UsacConfigExtension()

| Syntax | No. of bits | Mnemonic |
|---|---|---|
| UsacConfigExtension() | | |
| { | | |
| numConfigExtensions = escapedValue(2,4,8) + 1; | | |
| for (confExtIdx=0; confExtIdx<numConfigExtensions; confExtIdx++) { | | |
| usacConfigExtType[confExtIdx] = escapedValue(4,8,16); | | |
| usacConfigExtLenght[confExtIdx] = escapedValue(4,8,16); | | |
| switch (usacConfigExtType[confExtIdx]) { | | |
| case ID_CONFIG_EXT_FILL: | | |
| while (usacConfigExtLenght[confExtIdx]--) { | | |
| **fill_byte[i];** /* should be '10100101' */ | **8** | **uimsbf** |
| } | | |
| break; | | |
| default: | | |
| while (usacConfigExtLenght[confExtIdx]--) { | | |
| **tmp;** | **8** | **uimsbf** |
| } | | |
| break; | | |
| } | | |
| } | | |
| } | | |

FIG 6L

Syntax of escapedValue()

| Syntax | No. of bits | Mnemonic |
|---|---|---|
| escapedValue(nBits1, nBits2, nBits3) | | |
| { | | |
| **value;** | **nBits1** | **uimsbf** |
| if (value ==$2^{nBits1}$ -1) { | | |
| value += **valueAdd;** | **nBits2** | **uimsbf** |
| if (valueAdd ==$2^{nBits2}$ -1) { | | |
| value += **valueAdd;** | **nBits3** | **uimsbf** |
| } | | |
| } | | |
| return value; | | |
| } | | |

FIG 6M

| channel element | channel | configuration data |
|---|---|---|
| SCE | C | PVC on<br>noise filling on |
| CPE 1 | L/R | PVC off<br>M/S stereo coding<br>noise filling on |
| CPE 2 | Ls/Rs | PVC off<br>parametric stereo coding<br>noise filling off |
| LFE | LFE | no time warp, no noise filling |

tools signaled in configuration section for a channel element:

stereo features
- MPS212 configuration core features
- time warp tool ON/OFF
- noise filling tool ON/OFF SBR features
- harmonic SBR tool ON/OFF
- inter time envelope shaping ON/OFF
- predictive vector coding ON/OFF
- all SBR parameter in SbrDfltHeader

FIG 7

Block Diagram of the USAC encoder

Block Diagram of the USAC decoder

AUDIO ENCODER AND DECODER HAVING A FLEXIBLE CONFIGURATION FUNCTIONALITY

CROSS-REFERENCE TO RELATED APPLICATIONS

This application is a continuation of copending International Application No. PCT/EP2012/054749, filed Mar. 19, 2012, which is incorporated herein by reference in its entirety, and additionally claims priority from U.S. Application No. 61/454,121, filed Mar. 18, 2011, which is also incorporated herein by reference in its entirety.

BACKGROUND OF THE INVENTION

The present invention relates to audio coding and particularly to high quality and low bitrate coding such as known from the so-called USAC coding (USAC=Unified Speech and Audio Coding).

The USAC coder is defined in ISO/IEC CD 23003-3. This standard named "Information technology—MPEG audio technologies—Part 3: Unified speech and audio coding" describes in detail the functional blocks of a reference model of a call for proposals on unified speech and audio coding.

FIGS. 10*a* and 10*b* illustrate encoder and decoder block diagrams. The block diagrams of the USAC encoder and decoder reflect the structure of MPEG-D USAC coding. The general structure can be described like this: First there is a common pre/post-processing consisting of an MPEG Surround (MPEGS) functional unit to handle stereo or multichannel processing and an enhanced SBR (eSBR) unit which handles the parametric representation of the higher audio frequencies in the input signal. Then there are two branches, one consisting of a modified Advanced Audio Coding (AAC) tool path and the other consisting of a linear prediction coding (LP or LPC domain) based path, which in turn features either a frequency domain representation or a time domain representation of the LPC residual. All transmitted spectra for both, AAC and LPC, are represented in MDCT domain following quantization and arithmetic coding. The time domain representation uses an ACELP excitation coding scheme.

The basic structure of the MPEG-D USAC is shown in FIG. 10*a* and FIG. 10*b*. The data flow in this diagram is from left to right, top to bottom. The functions of the decoder are to find the description of the quantized audio spectra or time domain representation in the bitstream payload and decode the quantized values and other reconstruction information.

In case of transmitted spectral information the decoder shall reconstruct the quantized spectra, process the reconstructed spectra through whatever tools are active in the bitstream payload in order to arrive at the actual signal spectra as described by the input bitstream payload, and finally convert the frequency domain spectra to the time domain. Following the initial reconstruction and scaling of the spectrum reconstruction, there are optional tools that modify one or more of the spectra in order to provide more efficient coding.

In case of transmitted time domain signal representation, the decoder shall reconstruct the quantized time signal, process the reconstructed time signal through whatever tools are active in the bitstream payload in order to arrive at the actual time domain signal as described by the input bitstream payload.

For each of the optional tools that operate on the signal data, the option to "pass through" is retained, and in all cases where the processing is omitted, the spectra or time samples at its input are passed directly through the tool without modification.

In places where the bitstream changes its signal representation from time domain to frequency domain representation or from LP domain to non-LP domain or vice versa, the decoder shall facilitate the transition from one domain to the other by means of an appropriate transition overlap-add windowing.

eSBR and MPEGS processing is applied in the same manner to both coding paths after transition handling.

The input to the bitstream payload demultiplexer tool is the MPEG-D USAC bitstream payload. The demultiplexer separates the bitstream payload into the parts for each tool, and provides each of the tools with the bitstream payload information related to that tool.

The outputs from the bitstream payload demultiplexer tool are:

- Depending on the core coding type in the current frame either:
  - the quantized and noiselessly coded spectra represented by
  - scale factor information
  - arithmetically coded spectral lines
- or: linear prediction (LP) parameters together with an excitation signal represented by either:
  - quantized and arithmetically coded spectral lines (transform coded excitation, TCX) or
  - ACELP coded time domain excitation
- The spectral noise filling information (optional)
- The M/S decision information (optional)
- The temporal noise shaping (TNS) information (optional)
- The filterbank control information
- The time unwarping (TW) control information (optional)
- The enhanced spectral bandwidth replication (eSBR) control information (optional)
- The MPEG Surround (MPEGS) control information The scale factor noiseless decoding tool takes information from the bitstream payload demultiplexer, parses that information, and decodes the Huffman and DPCM coded scale factors.

The input to the scale factor noiseless decoding tool is:

- The scale factor information for the noiselessly coded spectra

The output of the scale factor noiseless decoding tool is:

- The decoded integer representation of the scale factors:

The spectral noiseless decoding tool takes information from the bitstream payload demultiplexer, parses that information, decodes the arithmetically coded data, and reconstructs the quantized spectra. The input to this noiseless decoding tool is:

- The noiselessly coded spectra

The output of this noiseless decoding tool is:

- The quantized values of the spectra

The inverse quantizer tool takes the quantized values for the spectra, and converts the integer values to the non-scaled, reconstructed spectra. This quantizer is a companding quantizer, whose companding factor depends on the chosen core coding mode.

The input to the Inverse Quantizer tool is:

- The quantized values for the spectra

The output of the inverse quantizer tool is:

- The un-scaled, inversely quantized spectra

The noise filling tool is used to fill spectral gaps in the decoded spectra, which occur when spectral value are quantized to zero e.g. due to a strong restriction on bit demand in the encoder. The use of the noise filling tool is optional.

The inputs to the noise filling tool are:

The un-scaled, inversely quantized spectra

Noise filling parameters

The decoded integer representation of the scale factors

The outputs to the noise filling tool are:

The un-scaled, inversely quantized spectral values for spectral lines which were previously quantized to zero.

Modified integer representation of the scale factors

The rescaling tool converts the integer representation of the scale factors to the actual values, and multiplies the un-scaled inversely quantized spectra by the relevant scale factors.

The inputs to the scale factors tool are:

The decoded integer representation of the scale factors

The un-scaled, inversely quantized spectra

The output from the scale factors tool is:

The scaled, inversely quantized spectra

For an overview over the M/S tool, please refer to ISO/IEC 14496-3:2009, 4.1.1.2.

For an overview over the temporal noise shaping (TNS) tool, please refer to ISO/IEC 14496-3:2009, 4.1.1.2.

The filterbank/block switching tool applies the inverse of the frequency mapping that was carried out in the encoder. An inverse modified discrete cosine transform (IMDCT) is used for the filterbank tool. The IMDCT can be configured to support 120, 128, 240, 256, 480, 512, 960 or 1024 spectral coefficients.

The inputs to the filterbank tool are:

The (inversely quantized) spectra

The filterbank control information

The output(s) from the filterbank tool is (are):

The time domain reconstructed audio signal(s).

The time-warped filterbank/block switching tool replaces the normal filterbank/block switching tool when the time warping mode is enabled. The filterbank is the same (IMDCT) as for the normal filterbank, additionally the windowed time domain samples are mapped from the warped time domain to the linear time domain by time-varying resampling.

The inputs to the time-warped filterbank tools are:

The inversely quantized spectra

The filterbank control information

The time-warping control information

The output(s) from the filterbank tool is (are):

The linear time domain reconstructed audio signal(s).

The enhanced SBR (eSBR) tool regenerates the highband of the audio signal. It is based on replication of the sequences of harmonics, truncated during encoding. It adjusts the spectral envelope of the generated highband and applies inverse filtering, and adds noise and sinusoidal components in order to recreate the spectral characteristics of the original signal.

The input to the eSBR tool is:

The quantized envelope data

Misc. control data a time domain signal from the frequency domain core decoder or the ACELP/TCX core decoder The output of the eSBR tool is either:

a time domain signal or a QMF-domain representation of a signal, e.g. in the MPEG Surround tool is used.

The MPEG Surround (MPEGS) tool produces multiple signals from one or more input signals by applying a sophisticated upmix procedure to the input signal(s) controlled by appropriate spatial parameters. In the USAC context MPEGS is used for coding a multi-channel signal, by transmitting parametric side information alongside a transmitted downmixed signal.

The input to the MPEGS tool is:

a downmixed time domain signal or a QMF-domain representation of a downmixed signal from the eSBR tool The output of the MPEGS tool is:

a multi-channel time domain signal

The Signal Classifier tool analyses the original input signal and generates from it control information which triggers the selection of the different coding modes. The analysis of the input signal is implementation dependent and will try to choose the optimal core coding mode for a given input signal frame. The output of the signal classifier can (optionally) also be used to influence the behavior of other tools, for example MPEG Surround, enhanced SBR, time-warped filterbank and others.

The input to the signal Classifier tool is:

the original unmodified input signal additional implementation dependent parameters The output of the Signal Classifier tool is:

a control signal to control the selection of the core codec (non-LP filtered frequency domain coding, LP filtered frequency domain or LP filtered time domain coding)

The ACELP tool provides a way to efficiently represent a time domain excitation signal by combining a long term predictor (adaptive codeword) with a pulse-like sequence (innovation codeword). The reconstructed excitation is sent through an LP synthesis filter to form a time domain signal.

The input to the ACELP tool is:

adaptive and innovation codebook indices adaptive and innovation codes gain values other control data inversely quantized and interpolated LPC filter coefficients The output of the ACELP tool is:

The time domain reconstructed audio signal

The MDCT based TCX decoding tool is used to turn the weighted LP residual representation from an MDCT-domain back into a time domain signal and outputs a time domain signal including weighted LP synthesis filtering. The IMDCT can be configured to support 256, 512, or 1024 spectral coefficients.

The input to the TCX tool is:

The (inversely quantized) MDCT spectra inversely quantized and interpolated LPC filter coefficients The output of the TCX tool is:

The time domain reconstructed audio signal

The technology disclosed in ISO/IEC CD 23003-3, which is incorporated herein by reference allows the definition of channel elements which are, for example, single channel elements only containing payload for a single channel or channel pair elements comprising payload for two channels or LFE (Low-Frequency Enhancement) channel elements comprising payload for an LFE channel.

A five-channel multi-channel audio signal can, for example, be represented by a single channel element comprising the center channel, a first channel pair element comprising the left channel and the right channel, and a second channel pair element comprising the left surround channel (Ls) and the right surround channel (Rs). These different channel elements which together represent the multi-channel audio signal are fed into a decoder and are processed using the same decoder configuration. In accordance with conventional technology, the decoder configuration sent in the USAC specific config element was applied by the decoder to all channel elements and therefore the situation exists that elements of the configuration valid for all channel elements could not be selected for an individual channel element in an optimum way, but had to be set for all channel elements simultaneously. On the other hand, however, it has been found out that the channel elements for describing a straightforward five-channel multi-channel signal are very different from each other. The center channel being the single channel element has significantly different characteristics from the channel pair elements describing the left/right channels and the left surround/right surround channels, and additionally the characteristics of the two channel pair elements are also significantly different due to the fact that surround channels comprise information which is heavily different from the information comprised in the left and right channels.

The selection of configuration data for all channel elements together necessitated compromises so that a configuration has to be selected which is non-optimum for all channel elements, but which represents a compromise between all channel elements. Alternatively, the configuration has been selected to be optimum for one channel element, but this inevitably led to the situation that the configuration was non-optimum for the other channel elements. This, however, results in an increased bitrate for the channel elements having the non-optimum configuration or alternatively or additionally results in a reduced audio quality for these channel elements which do not have the optimum configuration settings.

SUMMARY

According to an embodiment, an audio decoder for decoding an encoded audio signal, the encoded audio signal having a first channel element and a second channel element in a payload section of a data stream and first decoder configuration data for the first channel element and second decoder configuration data for the second channel element in a configuration section of the data stream, may have: a data stream reader for reading the configuration data for each channel element in the configuration section and for reading the payload data for each channel element in the payload section; a configurable decoder for decoding the plurality of channel elements; and a configuration controller for configuring the configurable decoder so that the configurable decoder is configured in accordance with the first decoder configuration data when decoding the first channel element and in accordance with the second decoder configuration data when decoding the second channel element.

According to another embodiment, a method of decoding an encoded audio signal, the encoded audio signal having a first channel element and a second channel element in a payload section of a data stream and first decoder configuration data for the first channel element and second decoder configuration data for the second channel element in a configuration section of the data stream, may have the steps of: reading the configuration data for each channel element in the configuration section and for reading the payload data for each channel element in the payload section; decoding the plurality of channel elements by a configurable decoder; and configuring the configurable decoder so that the configurable decoder is configured in accordance with the first decoder configuration data when decoding the first channel element and in accordance with the second decoder configuration data when decoding the second channel element.

According to another embodiment, an audio encoder for encoding a multi-channel audio signal may have: a configuration processor for generating first configuration data for a first channel element and second configuration data for a second channel element; a configurable encoder for encoding the multi-channel audio signal to obtain the first channel element and the second channel element using the first configuration data and the second configuration data; and a data stream generator for generating a data stream representing an encoded audio signal, the data stream having a configuration section having the first configuration data and the second configuration data and a payload section having the first channel element and the second channel element.

According to another embodiment, a method of encoding a multi-channel audio signal may have the steps of: generating first configuration data for a first channel element and second configuration data for a second channel element; encoding the multi-channel audio signal by a configurable encoder to obtain the first channel element and the second channel element using the first configuration data and the second configuration data; and generating a data stream representing an encoded audio signal, the data stream having a configuration section having the first configuration data and the second configuration data and a payload section having the first channel element and the second channel element.

Another embodiment may have a computer program for performing, when running on a computer, the inventive methods.

According to another embodiment, an encoded audio signal may have: a configuration section having first decoder configuration data for a first channel element and second decoder configuration data for a second channel element, a channel element being an encoded representation of a single channel or two channels of a multichannel audio signal; and a payload section having payload data for the first channel element and the second channel element.

The present invention is based on the finding that an improved audio encoding/decoding concept is obtained when the decoder configuration data for each individual channel element is transmitted. In accordance with the present invention, the encoded audio signal therefore comprises a first channel element and a second channel element in a payload section of a data stream and first decoder configuration data for the first channel element and second decoder configuration data for the second channel element in a configuration section of the data stream. Hence, the payload section of the data stream where the payload data for the channel elements is located, is separated from the configuration data for the data stream, where the configuration data for the channel elements is located. It is advantageous that the configuration section is a contiguous portion of a serial bitstream, where all bits belonging to this payload section or contiguous portion of the bitstream are configuration data. Advantageously, the configuration data section is followed by the payload section of the data stream, where the payload for the channel elements is located. The inventive audio decoder comprises a data stream reader for reading the configuration data for each channel element in the configuration section and for reading the payload data for each channel element in the payload section. Furthermore, the audio decoder comprises a configurable decoder for decoding the plurality of channel elements and a configuration controller for configuring the configurable decoder so that the configurable decoder is configured in accordance with the first decoder configuration data when decoding the first channel element and in accordance with the second decoder configuration data when decoding the second channel element.

Thus, it is made sure that for each channel element the optimum configuration can be selected. This allows to optimally account for the different characteristics of the different channel elements.

An audio encoder in accordance with the present invention is arranged for encoding a multi-channel audio signal having, for example, at least two, three or more than three channels. The audio encoder comprises a configuration processor for generating first configuration data for a first channel element and second configuration data for a second channel element and a configurable encoder for encoding the multi-channel audio signal to obtain a first channel element and a second channel element using the first and the second configuration data, respectively. Furthermore, the audio encoder comprises a data stream generator for generating a data stream representing the encoded audio signal, the data stream having a configuration section having the first and the second configuration data and a payload section comprising the first channel element and the second channel element.

Now, the encoder as well as the decoder are in the position to determine an individual and optimum configuration data for each channel element.

This makes sure that the configurable decoder for each channel element is configured in such a way that for each channel element the optimum with respect to audio quality and bitrate can be obtained and compromises do not have to be made anymore.

BRIEF DESCRIPTION OF THE DRAWINGS

Embodiments of the present invention will be detailed subsequently referring to the appended drawings, in which:

FIGS. 3*a* and 3*b* represent a table outlining channel configurations for different speaker setups;

FIGS. 4*a* and 4*b* identify and graphically illustrate different speaker setups;

FIG. 6*a* illustrates the syntax of the UsacConfig element;

FIG. 6*b* illustrates the syntax of the UsacChannelConfig element;

FIG. 6*c* illustrates the syntax of the UsacDecoderConfig;

FIG. 6*d* illustrates the syntax of UsacSingleChannelElementConfig;

FIG. 6*e* illustrates the syntax of UsacChannelPairElementConfig;

FIG. 6*f* illustrates the syntax of UsacLfeElementConfig;

FIG. 6*g* illustrates the syntax of UsacCoreConfig;

FIG. 6*h* illustrates the syntax of SbrConfig;

FIG. 6*i* illustrates the syntax of SbrDfltHeader;

FIG. 6*j* illustrates the syntax of Mps212Config;

FIG. 6*k* illustrates the syntax of UsacExtElementConfig;

FIG. 6L illustrates the syntax of UsacConfigExtension;

FIG. 6*m* illustrates the syntax of escapedValue;

FIG. 7 illustrates different alternatives for identifying and configuring different encoder/decoder tools for a channel element individually;

DETAILED DESCRIPTION OF THE INVENTION

Figure 1:
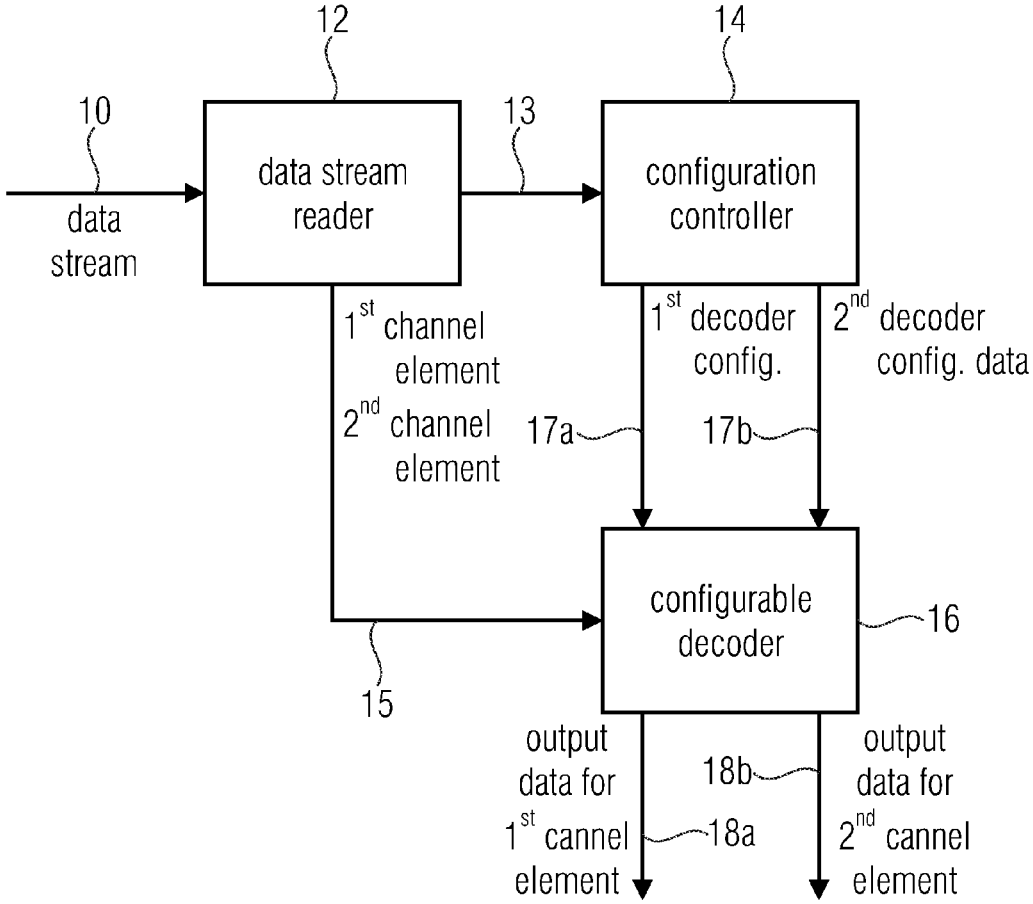
FIG. 1 is a block diagram of a decoder.

High level information, like sampling rate, exact channel configuration, about the contained audio content is present in the audio bitstream. This makes the bitstream more self contained and makes transport of the configuration and payload easier when embedded in transport schemes which may have no means to explicitly transmit this information.

The configuration structure contains a combined frame length and SBR sampling rate ratio index (coreSbrFrameLengthIndex)). This guarantees efficient transmission of both values and makes sure that non-meaningful combinations of frame length and SBR ratio cannot be signaled. The latter simplifies the implementation of a decoder.

The configuration can be extended by means of a dedicated configuration extension mechanism. This will prevent bulky and inefficient transmission of configuration extensions as known from the MPEG-4 AudioSpecificConfig( ).

Configuration allows free signaling of loudspeaker positions associated with each transmitted audio channel. Signaling of commonly used channel to loudspeaker mappings can be efficiently signaled by means of a channelConfigurationIndex.

Configuration of each channel element is contained in a separate structure such that each channel element can be configured independently.

SBR configuration data (the "SBR header") is split into an Sbrinfo( ) and an SbrHeader( ). For the SbrHeader( ) a default version is defined (SbrDfltHeader( )), which can be efficiently referenced in the bitstream. This reduces the bit demand in places where re-transmission of SBR configuration data is needed.

More commonly applied configuration changes to SBR can be efficiently signaled with the help of the SbrInfo( ) syntax element.

The configuration for the parametric bandwidth extension (SBR) and the parametric stereo coding tools (MPS212, aka. MPEG Surround 2-1-2) is tightly integrated into the USAC configuration structure. This represents much better the way that both technologies are actually employed in the standard.

The syntax features an extension mechanism which allows transmission of existing and future extensions to the codec.

The extensions may be placed (i.e. interleaved) with the channel elements in any order. This allows for extensions which need to be read before or after a particular channel element which the extension shall be applied on.

A default length can be defined for a syntax extension, which makes transmission of constant length extensions very efficient, because the length of the extension payload does not need to be transmitted every time.

The common case of signaling a value with the help of an escape mechanism to extend the range of values if needed was modularized into a dedicated genuine syntax element (escapedValue( )) which is flexible enough to cover all desired escape value constellations and bit field extensions.

Bitstream Configuration

UsacConfig( ) (FIG. 6*a*)

The UsacConfig( ) was extended to contain information about the contained audio content as well as everything needed for the complete decoder set-up. The top level information about the audio (sampling rate, channel configuration, output frame length) is gathered at the beginning for easy access from higher (application) layers.

channelConfigurationIndex, UsacChannelConfig( ) (FIG. 6*b*)

These elements give information about the contained bitstream elements and their mapping to loudspeakers. The channelConfigurationIndex allows for an easy and convenient way of signaling one out of a range of predefined mono, stereo or multi-channel configurations which were considered practically relevant.

For more elaborate configurations which are not covered by the channelConfigurationIndex the UsacChannelConfig( ) allows for a free assignment of elements to loudspeaker position out of a list of 32 speaker positions, which cover all currently known speaker positions in all known speaker set-ups for home or cinema sound reproduction.

This list of speaker positions is a superset of the list featured in the MPEG Surround standard (see Table 1 and FIG. 1 in ISO/IEC 23003-1). Four additional speaker positions have been added to be able to cover the lately introduced 22.2 speaker set-up (see FIGS. 3*a*, 3*b*, 4*a* and 4*b*).

UsacDecoderConfig( ) (FIG. 6*c*)

This element is at the heart of the decoder configuration and as such it contains all further information necessitated by the decoder to interpret the bitstream.

In particular the structure of the bitstream is defined here by explicitly stating the number of elements and their order in the bitstream.

A loop over all elements then allows for configuration of all elements of all types (single, pair, lfe, extension).

UsacConfigExtension( ) (FIG. 6*l*)

In order to account for future extensions, the configuration features a powerful mechanism to extend the configuration for yet non-existent configuration extensions for USAC.

UsacSingleChannelElementConfig( ) (FIG. 6*d*)

This element configuration contains all information needed for configuring the decoder to decode one single channel. This is essentially the core coder related information and if SBR is used the SBR related information.

UsacChannelPairElementConfig( ) (FIG. 6*e*)

In analogy to the above this element configuration contains all information needed for configuring the decoder to decode one channel pair. In addition to the above mentioned core config and SBR configuration this includes stereo-specific configurations like the exact kind of stereo coding applied (with or without MPS212, residual etc.). Note that this element covers all kinds of stereo coding options available in USAC.

UsacLfeElementConfig( ) (FIG. 6*f*)

The LFE element configuration does not contain configuration data as an LFE element has a static configuration.

UsacExtElementConfig( ) (FIG. 6*k*)

This element configuration can be used for configuring any kind of existing or future extensions to the codec. Each extension element type has its own dedicated ID value. A length field is included in order to be able to conveniently skip over configuration extensions unknown to the decoder. The optional definition of a default payload length further increases the coding efficiency of extension payloads present in the actual bitstream.

Extensions which are already envisioned to be combined with USAC include: MPEG Surround, SAOC, and some sort of FIL element as known from MPEG-4 AAC.

UsacCoreConfig( ) (FIG. 6*g*)

This element contains configuration data that has impact on the core coder set-up.

Currently these are switches for the time warping tool and the noise filling tool.

SbrConfig( ) (FIG. 6*h*)

In order to reduce the bit overhead produced by the frequent re-transmission of the sbr_header( ) default values for the elements of the sbr_header( ) that are typically kept constant are now carried in the configuration element SbrDfltHeader( ). Furthermore, static SBR configuration elements are also carried in SbrConfig( ). These static bits include flags for en- or disabling particular features of the enhanced SBR, like harmonic transposition or inter TES.

SbrDfltHeader( ) (FIG. 6*i*)

This carries elements of the sbr_header( ) that are typically kept constant. Elements affecting things like amplitude resolution, crossover band, spectrum preflattening are now carried in SbrInfo( ) which allows them to be efficiently changed on the fly.

Mps212Config( ) (FIG. 6*j*)

Similar to the above SBR configuration, all set-up parameters for the MPEG Surround 2-1-2 tools are assembled in this configuration. All elements from SpatialSpecificConfig( ) that are not relevant or redundant in this context were removed.

Bitstream Payload

UsacFrame( )

This is the outermost wrapper around the USAC bitstream payload and represents a USAC access unit. It contains a loop over all contained channel elements and extension elements as signaled in the config part. This makes the bitstream format much more flexible in terms of what it can contain and is future proof for any future extension.

UsacSingleChannelElement( )

This element contains all data to decode a mono stream. The content is split in a core coder related part and an eSBR related part. The latter is now much more closely connected to the core, which reflects also much better the order in which the data is needed by the decoder.

UsacChannelPairElement( )

This element covers the data for all possible ways to encode a stereo pair. In particular, all flavors of unified stereo coding are covered, ranging from legacy M/S based coding to fully parametric stereo coding with the help of MPEG Surround 2-1-2. stereoConfigIndex indicates which flavor is actually used. Appropriate eSBR data and MPEG Surround 2-1-2 data is sent in this element.

UsacLfeElement( )

The former lfe_channel_element( ) is renamed only in order to follow a consistent naming scheme.

UsacExtElement( )

The extension element was carefully designed to be able to be maximally flexible but at the same time maximally efficient even for extensions which have a small payload (or frequently none at all). The extension payload length is signaled for nescient decoders to skip over it. User-defined extensions can be signaled by means of a reserved range of extension types. Extensions can be placed freely in the order of elements. A range of extension elements has already been considered including a. mechanism to write fill bytes.

UsacCoreCoderData( )

This new element summarizes all information affecting the core coders and hence also contains fd_channel_stream( )'s and lpd_channel_stream( )'s.

StereoCoreToolInfo( )

In order to ease the readability of the syntax, all stereo related information was captured in this element. It deals with the numerous dependencies of bits in the stereo coding modes.

UsacSbrData( )

CRC functionality and legacy description elements of scalable audio coding were removed from what used to be the sbr_extension_data( ) element. In order to reduce the overhead caused by frequent re-transmission of SBR info and header data, the presence of these can be explicitly signaled.

SbrInfo( )

SBR configuration data that is frequently modified on the fly. This includes elements controlling things like amplitude resolution, crossover band, spectrum preflattening, which previously necessitated the transmission of a complete sbr_header( ) (see 6.3 in [N11660], "Efficiency").

SbrHeader( )

In order to maintain the capability of SBR to change values in the sbr_header( ) on the fly, it is now possible to carry an SbrHeader( ) inside the UsacSbrData( ) in case other values than those sent in SbrDfltHeader( ) should be used. The bs_header_extra mechanism was maintained in order to keep overhead as low as possible for the most common cases.

sbr_data( )

Again, remnants of SBR scalable coding were removed because they are not applicable in the USAC context. Depending on the number of channels the sbr_data( ) contains one sbr_single_channel_element( ) or one sbr_channel_pair_element( ).

usacSamplingFrequencyIndex

This table is a superset of the table used in MPEG-4 to signal the sampling frequency of the audio codec. The table was further extended to also cover the sampling rates that are currently used in the USAC operating modes. Some multiples of the sampling frequencies were also added.

channelConfigurationIndex

This table is a superset of the table used in MPEG-4 to signal the channelConfiguration. It was further extended to allow signaling of commonly used and envisioned future loudspeaker setups. The index into this table is signaled with 5 bits to allow for future extensions.

usacElementType

Only 4 element types exist. One for each of the four basic bitstream elements: UsacSingleChannelElement( ), UsacChannelPairElement( ), UsacLfeElement( ), UsacExtElement( ), These elements provide the necessitated top level structure while maintaining all needed flexibility.

usacExtElementType

Inside of UsacExtElement( ), this element allows to signal a plethora of extensions. In order to be future proof the bit field was chosen large enough to allow for all conceivable extensions. Out of the currently known extensions already few are proposed to be considered: fill element, MPEG Surround, and SAOC.

usacConfigExtType

Should it at some point be necessitated to extend the configuration then this can be handled by means of the UsacConfigExtension( ) which would then allow to assign a type to each new configuration. Currently the only type which can be signaled is a fill mechanism for the configuration.

coreSbrFrameLengthIndex

This table shall signal multiple configuration aspects of the decoder. In particular these are the output frame length, the SBR ratio and the resulting core coder frame length (ccfl). At the same time it indicates the number of QMF analysis and synthesis bands used in SBR stereoConfigIndex This table determines the inner structure of a UsacChannelPairElement( ). It indicates the use of a mono or stereo core, use of MPS212, whether stereo SBR is applied, and whether residual coding is applied in MPS212.

By moving large parts of the eSBR header fields to a default header which can be referenced by means of a default header flag, the bit demand for sending eSBR control data was greatly reduced. Former sbr_header( ) bit fields that were considered to change most likely in a real world system were outsourced to the sbrInfo( ) element instead which now consists only of 4 elements covering a maximum of 8 bits. Compared to the sbr_header( ), which consists of at least 18 bits this is a saving of 10 bit.

It is more difficult to assess the impact of this change on the overall bitrate because it depends heavily on the rate of transmission of eSBR control data in sbrInfo( ). However, already for the common use case where the sbr crossover is altered in a bitstream the bit saving can be as high as 22 bits per occurrence when sending an sbrInfo( ) instead of a fully transmitted sbr_header( ).

The output of the USAC decoder can be further processed by MPEG Surround (MPS) (ISO/IEC 23003-1) or SAOC (ISO/IEC 23003-2). If the SBR tool in USAC is active, a USAC decoder can typically be efficiently combined with a subsequent MPS/SAOC decoder by connecting them in the QMF domain in the same way as it is described for HE-AAC in ISO/IEC 23003-1 4.4. If a connection in the QMF domain is not possible, they need to be connected in the time domain.

If MPS/SAOC side information is embedded into a USAC bitstream by means of the usacExtElement mechanism (with usacExtElementType being ID_EXT_ELE_MPEGS or ID_EXT_ELE_SAOC), the time-alignment between the USAC data and the MPS/SAOC data assumes the most efficient connection between the USAC decoder and the MPS/SAOC decoder. If the SBR tool in USAC is active and if MPS/SAOC employs a 64 band QMF domain representation (see ISO/IEC 23003-1 6.6.3), the most efficient connection is in the QMF domain. Otherwise, the most efficient connection is in the time domain. This corresponds to the time-alignment for the combination of HE-AAC and MPS as defined in ISO/IEC 23003-1 4.4, 4.5, and 7.2.1.

The additional delay introduced by adding MPS decoding after USAC decoding is given by ISO/IEC 23003-1 4.5 and depends on whether HQ MPS or LP MPS is used, and whether MPS is connected to USAC in the QMF domain or in the time domain.

ISO/IEC 23003-1 4.4 clarifies the interface between USAC and MPEG Systems. Every access unit delivered to the audio decoder from the systems interface shall result in a corresponding composition unit delivered from the audio decoder to the systems interface, i.e., the compositor. This shall include start-up and shut-down conditions, i.e., when the access unit is the first or the last in a finite sequence of access units.

For an audio composition unit, ISO/IEC 14496-1 7.1.3.5 Composition Time Stamp (CTS) specifies that the composition time applies to the n-th audio sample within the composition unit. For US AC, the value of n is 1. Note that this applies to the output of the USAC decoder itself. In the case that a USAC decoder is, for example, being combined with an MPS decoder needs to be taken into account for the composition units delivered at the output of the MPS decoder.

Features of USAC Bitstream Payload Syntax

TABLE

Syntax of UsacFrame( )

| Syntax | No. of bits | Mne-monic |
|---|---|---|
| UsacFrame( ) | | |
| { | | |
| usacIndependencyFlag; | 1 | uimsbf |
| for (elemIdx=0; elemIdx<numElements; ++elemIdx) { | | |
| switch (usacElementType[elemIdx]) { | | |
| case: ID_USAC_SCE | | |
| UsacSingleChannelElement(usacIndependencyFlag); | | |
| break; | | |
| case: ID_USAC_CPE | | |
| UsacChannelPairElement(usacIndependencyFlag); | | |
| break; | | |
| case: ID_USAC_LFE | | |
| UsacLfeElement(usacIndependencyFlag); | | |
| break; | | |
| case: ID_USAC_EXT | | |
| UsacExtElement(usacIndependencyFlag); | | |
| break; | | |
| } | | |
| } | | |

TABLE

Syntax of UsacSingleChannelElement( )

| Syntax | No. of bits | Mnemonic |
|---|---|---|
| UsacSingleChannelElement(indepFlag) | | |
| { | | |
| UsacCoreCoderData(1, indepFlag); | | |
| if (sbrRatioIndex > 0) { | | |
| UsacSbrData(1, indepFlag); | | |
| } | | |
| } | | |

TABLE

Syntax of UsacChannelPairElement( )

| Syntax | No. of bits | Mnemonic |
|---|---|---|
| UsacChannelPairElement(indepFlag) | | |
| { | | |
| if (stereoConfigIndex == 1) { | | |
| nrCoreCoderChannels = 1; | | |
| } else { | | |
| nrCoreCoderChannels = 2; | | |
| } | | |
| UsacCoreCoderData(nrCoreCoderChannels, | | |
| indepFlag); | | |
| if (sbrRatioIndex > 0) { | | |
| if (stereoConfigIndex == 0 \|\| | | |
| stereoConfigIndex == 3) { | | |
| nrSbrChannels = 2; | | |
| } else { | | |
| nrSbrChannels = 1; | | |
| } | | |
| UsacSbrData(nrSbrChannels, indepFlag); | | |
| } | | |
| if (stereoConfigIndex > 0) { | | |
| Mps212Data(indepFlag); | | |
| } | | |
| } | | |

TABLE

Syntax of UsacLfeElement( )

| Syntax | No. of bits | Mnemonic |
|---|---|---|
| UsacLfeElement(indepFlag) | | |
| { | | |
| fd_channel_stream(0,0,0,0, indepFlag); | | |
| } | | |

TABLE

Syntax of UsacExtElement( )

| Syntax | No. of bits | Mnemonic |
|---|---|---|
| UsacExtElement(indepFlag) | | |
| { | | |
| usacExtElementUseDefaultLength; | 1 | |
| if (usacExtElementUseDefaultLength) { | | |
| usacExtElementPayloadLength = | | |
| usacExtElementDefaultLength; | | |
| } else { | | |
| usacExtElementPayloadLength = | | |
| escapedValue(8,16,0); | | |
| } | | |
| if (usacExtElementPayloadLength>0) { | | |
| if (usacExtElementPayloadFrag) { | | |
| usacExtElementStart; | 1 | uimsbf |
| usacExtElementStop; | 1 | uimsbf |
| } else { | | |
| usacExtElementStart = 1; | | |
| usacExtElementStop = 1; | | |
| } | | |
| for (i=0; i<usacExtElementPayloadLength; i++) { | | |
| usacExtElementSegmentData[i]; | 8 | uimsbf |
| } | | |
| } | | |
| } | | |

Features of the Syntax of Subsidiary Payload Elements

TABLE

Syntax of UsacCoreCoderData( )

| Syntax | No. of bits | Mnemonic |
|---|---|---|
| UsacCoreCoderData(nrChannels, indepFlag) | | |
| { | | |
| for (ch=0; ch < nrChannels; ch++) { | | |
| core_mode[ch]; | 1 | uimsbf |
| } | | |
| if (nrChannels == 2) { | | |
| StereoCoreToolInfo(core_mode); | | |
| } | | |
| for (ch=0; ch<nrChannels; ch++) { | | |
| if (core_mode[ch] == 1) { | | |
| lpd_channel_stream(indepFlag); | | |
| } | | |
| else { | | |
| if ( (nrChannels == 1) \|\| (core_mode[0] | | |
| != core_mode[1]) ) { | | |
| tns_data_present[ch]; | 1 | uimsbf |
| } | | |
| fd_channel_stream(common_window, | | |
| common_tw, | | |
| tns_data_present[ch], noiseFilling, | | |
| indepFlag); | | |
| } | | |
| } | | |
| } | | |

TABLE

Syntax of StereoCoreToolInfo( )

| Syntax | No. of bits | Mnemonic |
|---|---|---|
| StereoCoreToolInfo(core_mode) | | |
| { | | |
| if (core_mode[0] == 0 && core_mode[1] == 0) { | | |
| tns_active; | 1 | uimsbf |
| common_window; | 1 | uimsbf |
| if (common_window) { | | |
| ics_info( ); | | |
| common_max_sfb; | 1 | uimsbf |
| if (common_max_sfb == 0) { | | |
| if (window_sequence == | | |
| EIGHT_SHORT_SEQUENCE) { | | |
| max_sfb1; | 4 | uimsbf |
| } else { | | |
| max_sfb1; | 6 | uimsbf |
| } | | |
| } else { | | |
| max_sfb1 = max_sfb; | | |
| } | | |
| max_sfb_ste = max(max_sfb, max_sfb1); | | |
| ms_mask_present; | 2 | uimsbf |
| if ( ms_mask_present == 1 ) { | | |
| for (g = 0; g < num_window_groups; | | |
| g++) { | | |
| for (sfb = 0; sfb < max_sfb; sfb++) { | | |
| ms_used[g][sfb]; | 1 | uimsbf |
| } | | |
| } | | |
| } | | |
| if (ms_mask_present == 3) { | | |
| cplx_bred_data( ); | | |
| } else { | | |
| alpha_q_re[g][sfb] = 0; | | |
| alpha_q_im[g][sfb] = 0; | | |
| } | | |
| } | | |
| if (tw_mdct) { | | |
| common_tw; | 1 | uimsbf |
| if ( common_tw ) { | | |

TABLE-continued

Syntax of StereoCoreToolInfo( )

| Syntax | No. of bits | Mnemonic |
|---|---|---|
| tw_data( ); | | |
| } | | |
| } | | |
| if (tns_active) { | | |
| if (common_window) { | | |
| common_tns; | 1 | uimsbf |
| } else { | | |
| common_tns = 0; | | |
| } | | |
| tns_on_lr; | 1 | uimsbf |
| if (common_tns) { | | |
| tns_data( ); | | |
| tns_data_present[0] = 0; | | |
| tns_data_present[1] = 0; | | |
| } else { | | |
| tns_present_both; | 1 | uimsbf |
| if (tns_present_both) { | | |
| tns_data_present[0] = 1; | | |
| tns_data_present[1] = 1; | | |
| } else { | | |
| tns_data_present[1]; | 1 | uimsbf |
| tns_data_present[0] = 1 − | | |
| tns_data_present[1]; | | |
| } | | |
| } | | |
| } else { | | |
| common_tns = 0; | | |
| tns_data_present[0] = 0; | | |
| tns_data_present[1] = 0; | | |
| } | | |
| } else { | | |
| common_window = 0; | | |
| common_tw = 0; | | |
| } | | |
| } | | |

TABLE

Syntax of fd_channel_stream( )

| Syntax | No. of bits | Mnemonic |
|---|---|---|
| fd_channel_stream(common_window, common_tw, | | |
| tns_data_present, noiseFilling, indepFlag) | | |
| { | | |
| global_gain; | 8 | uimsbf |
| if (noiseFilling) { | | |
| noise_level; | 3 | uimsbf |
| noise_offset; | 5 | uimsbf |
| } | | |
| else { | | |
| noise_level = 0; | | |
| } | | |
| if (!common_window) { | | |
| ics_info( ); | | |
| } | | |
| if (tw_mdct) { | | |
| if ( ! common_tw ) { | | |
| tw_data( ); | | |
| } | | |
| } | | |
| scale_factor_data ( ); | | |
| if (tns_data_present) { | | |
| tns_data ( ); | | |
| } | | |
| ac_spectral_data( indepFlag); | | |
| fac_data_present; | 1 | uimsbf |
| if (fac_data_present) { | | |
| fac_length = (window_sequence== | | |

TABLE-continued

Syntax of fd_channel_stream( )

| Syntax | No. of bits | Mnemonic |
|---|---|---|
| EIGHT_SHORT_SEQUENCE) ? | | |
| ccfl/16 : ccfl/8; | | |
| fac_data(1, fac_length); | | |
| } | | |
| } | | |

TABLE

Syntax of lpd_channel_stream( )

| Syntax | No. of bits | Mnemonic |
|---|---|---|
| lpd_channel_stream(indepFlag) | | |
| { | | |
| acelp_core_mode; | 3 | uimsbf |
| lpd_mode; | 5 | uimsbf, Note 1 |
| bpf_control_info | 1 | uimsbf |
| core_mode_last; | 1 | uimsbf |
| fac_data_present; | 1 | uimsbf |
| first_lpd_flag = !core_mode_last; | | |
| first_tcx_flag=TRUE; | | |
| k = 0; | | |
| while (k < 4) { | | |
| if (k==0) { | | |
| if ( (core_mode_last==1) && | | |
| (fac_data_present==1) ) { | | |
| fac_data(0, ccfl/8); | | |
| } | | |
| } else { | | |
| if ( (last_lpd_mode==0 && mod[k]>0) \|\| | | |
| (last_lpd_mode>0 && mod[k]==0) ) { | | |
| fac_data(0, ccfl/8); | | |
| } | | |
| } | | |
| if (mod[k] == 0) { | | |
| acelp_coding(acelp_core_mode); | | |
| last_lpd_mode=0; | | |
| k += 1; | | |
| } | | |
| else { | | |
| tcx_coding( lg(mod[k]) , first_tcx_flag, indepFlag); | | Note 3 |
| last_lpd_mode=mod[k]; | | |
| k += ( 1 << (mod[k]−1) ); | | |
| first_tcx_flag=FALSE; | | |
| } | | |
| } | | |
| lpc_data(first_lpd_flag); | | |
| if (core_mode_last==0 && fac_data_present==1) | | |
| { | | |
| short_fac_flag; | 1 | uimsbf |
| fac_length = short_fac_flag ? ccfl/16 : ccfl/8; | | |
| fac_data(1, fac_length); | | |
| } | | |
| } | | |

TABLE

Syntax of fac_data( )

| Syntax | No. of bits | Mnemonic |
|---|---|---|
| fac_data(useGain, fac_length) | | |
| { | | |
| if (useGain) { | | |
| fac_gain; | 7 | uimsbf |
| } | | |
| for (i=0; i<fac_length/8; i++) { | | |
| code_book_indices (i, 1, 1); | | |
| } | | |
| } | | |

Note 1:

This value is encoded using a modified unary code, where qn = 0 is represented by one "0" bit, and any value qn greater or equal to 2 is represented by qn − 1 "1" bits followed by one "0" stop bit.

Note that qn = 1 cannot be signaled, because the codebook $Q_1$ is not defined.

Features of Enhanced SBR Payload Syntax

TABLE

Syntax of UsacSbrData( )

| Syntax | No. of bits | Mnemonic |
|---|---|---|
| UsacSbrData(harmonicSBR, numberSbrChannels, indepFlag) | | |
| { | | |
| if (indepFlag) { | | |
| sbrInfoPresent = 1; | | |
| sbrHeaderPresent = 1; | | |
| } else { | | |
| sbrInfoPresent; | 1 | uimsbf |
| if (sbrInfoPresent) { | | |
| sbrHeaderPresent; | 1 | uimsbf |
| } else { | | |
| sbrHeaderPresent = 0; | | |
| } | | |
| } | | |
| if (sbrInfoPresent) { | | |
| SbrInfo( ); | | |
| } | | |
| if (sbrHeaderPresent) { | | |
| sbrUseDfltHeader; | 1 | uimsbf |
| if (sbrUseDfltHeader) { | | |
| /* copy all SbrDfltHeader( ) elements dlft_xxx_yyy to bs_xxx_yyy */ | | |
| } else { | | |
| SbrHeader( ); | | |
| } | | |
| } | | |
| sbr_data(harmonicSBR, bs_amp_res, numberSbrChannels, indep-Flag); | | |

TABLE

Syntax of SbrInfo

| Syntax | No. of bits | Mnemonic |
|---|---|---|
| SbrInfo( ) | | |
| { | | |
| bs_amp_res; | 1 | |
| bs_xover_band; | 4 | Uimsbf |
| bs_sbr_preprocessing; | 1 | Uimsbf |
| if (bs_pvc) { | | |
| bs_pvc_mode; | 2 | uimsbf |
| } | | |
| } | | |

TABLE

Syntax of SbrHeader

| Syntax | No. of bits | Mnemonic |
|---|---|---|
| SbrHeader( ) | | |
| { | | |
| bs_start_freq; | 4 | uimsbf |
| bs_stop_freq; | 4 | uimsbf |
| bs_header_extra1; | 1 | uimsbf |
| bs_header_extra2; | 1 | uimsbf |
| if (bs_header_extra1 == 1) { | | |
| bs_freq_scale; | 2 | uimsbf |
| bs_alter_scale; | 1 | uimsbf |
| bs_noise_bands; | 2 | uimsbf |
| } | | |
| if (bs_header_extra2 == 1) { | | |
| bs_limiter_bands; | 2 | uimsbf |
| bs_limiter_gains; | 2 | uimsbf |
| bs_interpol_freq; | 1 | uimsbf |
| bs_smoothing_mode; | 1 | uimsbf |
| } | | |
| } | | |

Note 1:

bs_start_freq and bs_stop_freq shall define a frequency band that does not exceed the limits defined in ISO/IEC 14496-3:2009, 4.6.18.3.6.

Note 3:

If this bit is not set the default values for the underlying data elements shall be used disregarded any previous value.

TABLE

Syntax of sbr_data( )

| Syntax | No. of bits | Mnemonic |
|---|---|---|
| sbr_data(harmonicSBR, bs_amp_res, numberSbrChannels, indepFlag) | | |
| { | | |
| switch (numberSbrChannels) { | | |
| case 1: | | |
| sbr_single_channel_element(harmonicSBR, bs_amp_res, indepFlag); | | |
| break; | | |
| case 2: | | |
| sbr_channel_pair_element(harmonicSBR, bs_amp_res, indepFlag); | | |
| break; | | |
| } | | |

TABLE

Syntax of sbr_envelope( )

| Syntax | No. of bits | Mnemonic |
|---|---|---|
| sbr_envelope(ch, bs_coupling, bs_amp_res) | | |
| { | | |
| if (bs_coupling) { | | |
| if (ch) { | | |
| if (bs_amp_res) { | | |
| t_huff = t_huffman_env_bal_3_0dB; | | |
| f_huff = f_huffman_env_bal_3_0dB; | | |
| } else { | | |
| t_huff = t_huffman_env_bal_1_5dB; | | |
| f_huff = f_huffman_env_bal_1_5dB; | | |
| } | | |
| } else { | | |
| if (bs_amp_res) { | | |
| t_huff = t_huffman_env_3_0dB; | | |
| f_huff = f_huffman_env_3_0dB; | | |
| } else { | | |
| t_huff = t_huffman_env_1_5dB; | | |
| f_huff = f_huffman_env_1_5dB; | | |
| } | | |
| } | | |
| } else { | | |
| if (bs_amp_res) { | | |
| t_huff = t_huffman_env_3_0dB; | | |
| f_huff = f_huffman_env_3_0dB; | | |
| } else { | | |
| t_huff = t_huffman_env_1_5dB; | | |
| f_huff = f_huffman_env_1_5dB; | | |
| } | | |
| } | | |
| for (env = 0; env < bs_num_env[ch]; env++) { | | |
| if (bs_df_env[ch][env] == 0) { | | |
| if (bs_coupling && ch) { | | |
| if (bs_amp_res) | | |
| bs_data_env[ch][env][0] = bs_env_start_value_balance; | 5 | uimsbf |
| else | | |
| bs_data_env[ch][env][0] = bs_env_start_value_balance; | 6 | uimsbf |
| } else { | | |
| if (bs_amp_res) | | |
| bs_data_env[ch][env][0] = bs_env_start_value_level; | 6 | uimsbf |
| else | | |
| bs_data_env[ch][env][0] = bs_env_start_value_level; | 7 | uimsbf |
| } | | |
| for (band = 1; band < num_env_bands[bs_freq_res[ch][env]]; band++) | | Note 1 |

TABLE-continued

Syntax of sbr_envelope( )

| Syntax | No. of bits | Mnemonic |
|---|---|---|
| bs_data_env[ch][env][band] = sbr_huff_dec(f_huff, bs_codeword); | 1 . . . 18 | Note 2 |
| } else { | | |
| for (band = 0; band < num_env_bands[bs_freq_res[ch][env]]; band++) | | Note 1 |
| bs_data_env[ch][env][band] = sbr_huff_dec(t_huff, bs_codeword); | 1 . . . 18 | Note 2 |
| } | | |
| if (bs_interTes) { | | |
| bs_temp_shape[ch][env]; | 1 | uimsbf |
| if (bs_temp_shape[ch][env]) { | | |
| bs_inter_temp_shape_mode[ch][env]; | 2 | uimsbf |
| } | | |
| } | | |
| } | | |
| } | | |

Note 1: num_env_bands[bs_freq_res[ch][env]] is derived from the header according to ISO/IEC 14496-3:2009, 4.6.18.3 and is named n.
Note 2: sbr_huff_dec( ) is defined in ISO/IEC 14496-3:2009, 4.A.6.1.

TABLE

Syntax of FramingInfo( )

| Syntax | No. of bits | Mnemonic |
|---|---|---|
| FramingInfo( ) | | |
| { | | |
| if (bsHighRateMode) { | | |
| bsFramingType; | 1 | uimsbf |
| bsNumParamSets; | 3 | uimsbf |
| } else { | | |
| bsFramingType = 0; | | |
| bsNumParamSets = 1; | | |
| } | | |
| numParamSets = bsNumParamSets + 1; | | |
| nBitsParamSlot = ceil(log2(numSlots)); | | |
| if (bsFramingType) { | | |
| for (ps=0; ps<numParamSets; ps++) { | | |
| bsParamSlot[ps]; | nBitsParamSlot | uimsbf |
| } | | |
| } | | |
| } | | |

Short Description of Data Elements

UsacConfig( ) This element contains information about the contained audio content as well as everything needed for the complete decoder set-up UsacChannelConfig( ) This element give information about the contained bitstream elements and their mapping to loudspeakers UsacDecoderConfig( ) This element contains all further information necessitated by the decoder to interpret the bitstream. In particular the SBR resampling ratio is signaled here and the structure of the bitstream is defined here by explicitly stating the number of elements and their order in the bitstream UsacConfigExtension( ) Configuration extension mechanism to extend the configuration for future configuration extensions for USAC.

UsacSingleChannelElementConfig( ) contains all information needed for configuring the decoder to decode one single channel. This is essentially the core coder related information and if SBR is used the SBR related information.

UsacChannelPairElementConfig( ) In analogy to the above this element configuration contains all information needed for configuring the decoder to decode one channel pair. In addition to the above mentioned core config and sbr configuration this includes stereo specific configurations like the exact kind of stereo coding applied (with or without MPS212, residual etc.). This element covers all kinds of stereo coding options currently available in USAC.

UsacLfeElementConfig( ) The LFE element configuration does not contain configuration data as an LFE element has a static configuration.

UsacExtElementConfig( ) This element configuration can be used for configuring any kind of existing or future extensions to the codec. Each extension element type has its own dedicated type value. A length field is included in order to be able to skip over configuration extensions unknown to the decoder.

UsacCoreConfig( ) contains configuration data which have impact on the core coder set-up.

SbrConfig( ) contains default values for the configuration elements of eSBR that are typically kept constant. Furthermore, static SBR configuration elements are also carried in SbrConfig( ). These static bits include flags for en- or disabling particular features of the enhanced SBR, like harmonic transposition or inter TES.

SbrDfltHeader( ) This element carries a default version of the elements of the SbrHeader( ) that can be referred to if no differing values for these elements are desired.

Mps212Config( ) All set-up parameters for the MPEG Surround 2-1-2 tools are assembled in this configuration.

escapedValue( ) this element implements a general method to transmit an integer value using a varying number of bits. It features a two level escape mechanism which allows to extend the representable range of values by successive transmission of additional bits.

usacSamplingFrequencyIndex This index determines the sampling frequency of the audio signal after decoding. The value of usacSamplingFrequencyIndex and their associated sampling frequencies are described in Table C.

TABLE C

Value and meaning of usacSamplingFrequencyIndex

| usacSamplingFrequencyIndex | sampling frequency |
|---|---|
| 0x00 | 96000 |
| 0x01 | 88200 |
| 0x02 | 64000 |
| 0x03 | 48000 |
| 0x04 | 44100 |
| 0x05 | 32000 |
| 0x06 | 24000 |
| 0x07 | 22050 |
| 0x08 | 16000 |

TABLE C-continued

| Value and meaning of usacSamplingFrequencyIndex | |
|---|---|
| usacSamplingFrequencyIndex | sampling frequency |
| 0x09 | 12000 |
| 0x0a | 11025 |
| 0x0b | 8000 |
| 0x0c | 7350 |
| 0x0d | reserved |
| 0x0e | reserved |
| 0x0f | 57600 |
| 0x10 | 51200 |
| 0x11 | 40000 |
| 0x12 | 38400 |
| 0x13 | 34150 |
| 0x14 | 28800 |
| 0x15 | 25600 |
| 0x16 | 20000 |
| 0x17 | 19200 |
| 0x18 | 17075 |
| 0x19 | 14400 |
| 0x1a | 12800 |
| 0x1b | 9600 |
| 0x1c | reserved |
| 0x1d | reserved |
| 0x1e | reserved |
| 0x1f | escape value |

Figure 4B:
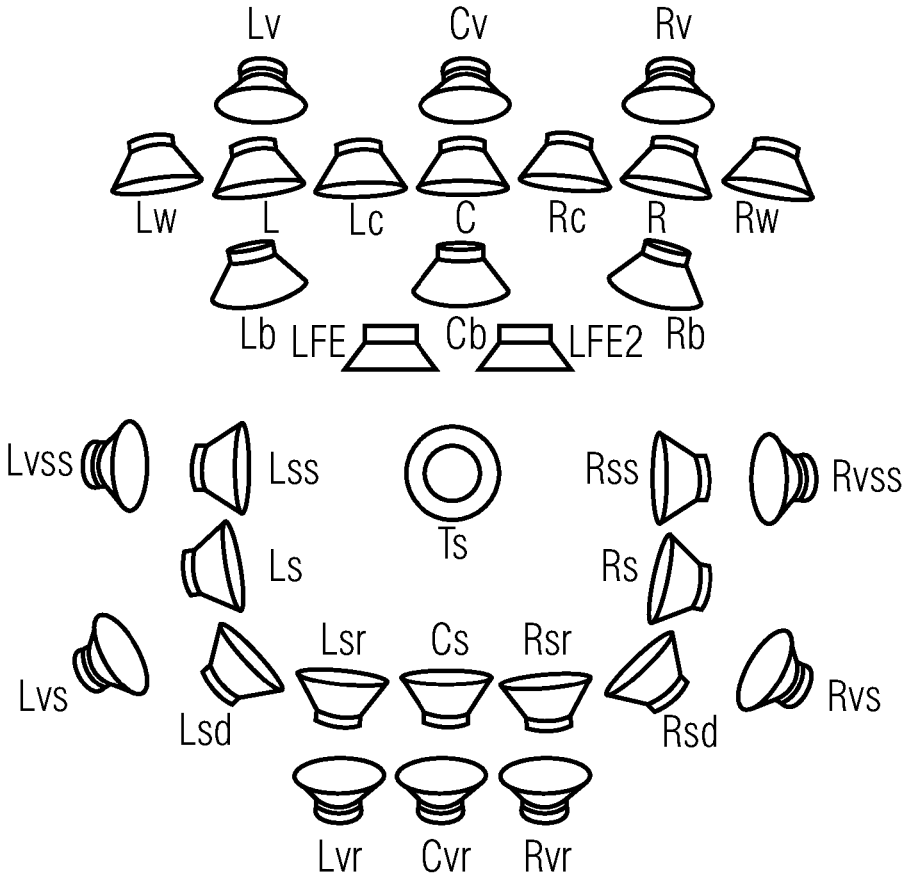

NOTE:
The values of UsacSamplingFrequencyIndex 0x00 up to 0x0e are identical to those of the samplingFrequencyIndex 0x0 up to 0xe contained in the AudioSpecificConfig( ) specified in ISO/IEC 14496-3:2009 usacSamplingFrequency Output sampling frequency of the decoder coded as unsigned integer value in case usacSamplingFrequencyIndex equals zero.

channelConfigurationIndex This index determines the channel configuration. If channelConfigurationIndex>0 the index unambiguously defines the number of channels, channel elements and associated loudspeaker mapping according to Table Y. The names of the loudspeaker positions, the used abbreviations and the general position of the available loudspeakers can be deduced from FIGS. 3*a*, 3*b* and FIGS. 4*a* and 4*b*.

bsOutputChannelPos This index describes loudspeaker positions which are associated to a given channel according to FIG. 4*a*. FIG. 4*b* indicates the loudspeaker position in the 3D environment of the listener. In order to ease the understanding of loudspeaker positions FIG. 4*a* also contains loudspeaker positions according to IEC 100/1706/CDV which are listed here for information to the interested reader.

TABLE

| Values of coreCoderFrameLength, sbrRatio, outputFrameLength and numSlots depending on coreSbrFrameLengthIndex | | | | |
|---|---|---|---|---|
| Index | coreCoder-FrameLength | sbrRatio (sbrRatioIndex) | output-FrameLength | Mps212 numSlots |
| 0 | 768 | no SBR (0) | 768 | N.A. |
| 1 | 1024 | no SBR (0) | 1024 | N.A. |
| 2 | 768 | 8:3 (2) | 2048 | 32 |
| 3 | 1024 | 2:1 (3) | 2048 | 32 |
| 4 | 1024 | 4:1 (1) | 4096 | 64 |
| 5-7 | | reserved | | |

usacConfigExtensionPresent Indicates the presence of extensions to the configuration numOutChannels If the value of channelConfigurationIndex indicates that none of the pre-defined channel configurations is used then this element determines the number of audio channels for which a specific loudspeaker position shall be associated.

numElements This field contains the number of elements that will follow in the loop over element types in the UsacDecoderConfig( )

usacElementType[elemIdx] defines the USAC channel element type of the element at position elemIdx in the bitstream. Four element types exist, one for each of the four basic bitstream elements: UsacSingleChannelElement( ), UsacChannelPairElement( ), UsacLfeElement( ), UsacExtElement( ). These elements provide the necessitated top level structure while maintaining all needed flexibility. The meaning of usacElementType is defined in Table A.

TABLE A

| Value of usacElementType | |
|---|---|
| usacElementType | Value |
| ID_USAC_SCE | 0 |
| ID_USAC_CPE | 1 |
| ID_USAC_LFE | 2 |
| ID_USAC_EXT | 3 |

stereoConfigIndex This element determines the inner structure of a UsacChannelPairElement( ). It indicates the use of a mono or stereo core, use of MPS212, whether stereo SBR is applied, and whether residual coding is applied in MPS212 according to Table ZZ. This element also defines the values of the helper elements bsStereoSbr and bsResidualCoding.

TABLE ZZ

| Values of stereoConfigIndex and its meaning and implicit assignment of bsStereoSbr and bsResidual Coding | | | |
|---|---|---|---|
| stereoConfigIndex | meaning | bsStereoSbr | bsResidualCoding |
| 0 | regular CPE (no MPS212) | N/A | 0 |
| 1 | single channel + MPS212 | N/A | 0 |
| 2 | two channels + MPS212 | 0 | 1 |
| 3 | two channels + MPS212 | 1 | 1 |

tw_mdct This flag signals the usage of the time-warped MDCT in this stream.

noiseFilling This flag signals the usage of the noise filling of spectral holes in the FD core coder.

harmonicSBR This flag signals the usage of the harmonic patching for the SBR.

bs_interTes This flag signals the usage of the inter-TES tool in SBR.

dflt_start_freq This is the default value for the bitstream element bs_start_freq, which is applied in case the flag sbrUseDfltHeader indicates that default values for the SbrHeader( ) elements shall be assumed.

dflt_stop_freq This is the default value for the bitstream element bs_stop_freq, which is applied in case the flag sbrUseDfltHeader indicates that default values for the SbrHeader( ) elements shall be assumed.

dflt_header_extra1 This is the default value for the bitstream element bs_header_extra1, which is applied in case the flag sbrUseDfltHeader indicates that default values for the SbrHeader( ) elements shall be assumed.

dflt_header_extra2 This is the default value for the bitstream element bs_header_extra2, which is applied in case the flag sbrUseDfltHeader indicates that default values for the SbrHeader( ) elements shall be assumed.

dflt_freq_scale This is the default value for the bitstream element bs_freq_scale, which is applied in case the flag sbrUseDfltHeader indicates that default values for the SbrHeader( ) elements shall be assumed.

dflt_alter_scale This is the default value for the bitstream element bs_alter_scale, which is applied in case the flag sbrUseDfltHeader indicates that default values for the SbrHeader( ) elements shall be assumed.

dflt_noise_bands This is the default value for the bitstream element bs_noise_bands, which is applied in case the flag sbrUseDfltHeader indicates that default values for the SbrHeader( ) elements shall be assumed.

dflt_limiter_bands This is the default value for the bitstream element bs_limiter_bands, which is applied in case the flag sbrUseDfltHeader indicates that default values for the SbrHeader( ) elements shall be assumed.

dflt_limiter_gains This is the default value for the bitstream element bs_limiter_gains, which is applied in case the flag sbrUseDfltHeader indicates that default values for the SbrHeader( ) elements shall be assumed.

dflt_interpol_freq This is the default value for the bitstream element bs_interpol_freq, which is applied in case the flag sbrUseDfltHeader indicates that default values for the SbrHeader( ) elements shall be assumed.

dflt_smoothing_mode This is the default value for the bitstream element bs_smoothing_mode, which is applied in case the flag sbrUseDfltHeader indicates that default values for the SbrHeader( ) elements shall be assumed.

usacExtElementType this element allows to signal bitstream extensions types. The meaning of usacExtElementType is defined in Table B.

TABLE B

Value of usacExtElementType

| usacExtElementType | Value |
|---|---|
| ID_EXT_ELE_FILL | 0 |
| ID_EXT_ELE_MPEGS | 1 |
| ID_EXT_ELE_SAOC | 2 |
| /* reserved for ISO use */ | 3-127 |
| /* reserved for use outside of ISO scope */ | 128 and higher |

NOTE:
Application-specific usacExtElementType values are mandated to be in the space reserved for use outside of ISO scope. These are skipped by a decoder as a minimum of structure is necessitated by the decoder to skip these extensions.

usacExtElementConfigLength signals the length of the extension configuration in bytes (octets).

usacExtElementDefaultLengthPresent This flag signals whether a usacExtElementDefaultLength is conveyed in the UsacExtElementConfig( ).

usacExtElementDefaultLength signals the default length of the extension element in bytes. Only if the extension element in a given access unit deviates from this value, an additional length needs to be transmitted in the bitstream. If this element is not explicitly transmitted (usacExtElementDefaultLengthPresent==0) then the value of usacExtElementDefaultLength shall be set to zero.

usacExtElementPayloadFrag This flag indicates whether the payload of this extension element may be fragmented and send as several segments in consecutive USAC frames.

numConfigExtensions If extensions to the configuration are present in the UsacConfig( ) this value indicates the number of signaled configuration extensions.

confExtIdx Index to the configuration extensions.

usacConfigExtType This element allows to signal configuration extension types. The meaning of usacExtElementType is defined in Table D.

TABLE D

Value of usacConfigExtType

| usacConfigExtType | Value |
|---|---|
| ID_CONFIG_EXT_FILL | 0 |
| /* reserved for ISO use */ | 1-127 |
| /* reserved for use outside of ISO scope */ | 128 and higher |

usacConfigExtLength signals the length of the configuration extension in bytes (octets).

bsPseudoLr This flag signals that an inverse mid/side rotation should be applied to the core signal prior to Mps212 processing.

TABLE bsPseudoLr

| bsPseudoLr | Meaning |
|---|---|
| 0 | Core decoder output is DMX/RES |
| 1 | Core decoder output is Pseudo L/R |

bsStereoSbr This flag signals the usage of the stereo SBR in combination with MPEG Surround decoding.

TABLE bsStereoSbr

| bsStereoSbr | Meaning |
|---|---|
| 0 | Mono SBR |
| 1 | Stereo SBR |

bsResidualCoding indicates whether residual coding is applied according to the Table below. The value of bsResidualCoding is defined by stereoConfigIndex (see X).

TABLE bsResidualCoding

| bsResidualCoding | Meaning |
|---|---|
| 0 | no residual coding, core coder is mono |
| 1 | residual coding, core coder is stereo |

sbrRatioIndex indicates the ratio between the core sampling rate and the sampling rate after eSBR processing. At the same time it indicates the number of QMF analysis and synthesis bands used in SBR according to the Table below.

TABLE

Definition of sbrRatioIndex

| sbrRatioIndex | sbrRatio | QMF band ratio (analysis:synthesis) |
|---|---|---|
| 0 | no SBR | — |
| 1 | 4:1 | 16:64 |
| 2 | 8:3 | 24:64 |
| 3 | 2:1 | 32:64 |

elemIdx Index to the elements present in the UsacDecoderConfig( ) and the UsacFrame( ).

UsacConfig( )

The UsacConfig( ) contains information about output sampling frequency and channel configuration. This information shall be identical to the information signaled outside of this element, e.g. in an MPEG-4 AudioSpecificConfig( ).

Usac Output Sampling Frequency

If the sampling rate is not one of the rates listed in the right column in Table 1, the sampling frequency dependent tables (code tables, scale factor band tables etc.) has to be deduced in order for the bitstream payload to be parsed. Since a given sampling frequency is associated with only one sampling frequency table, and since maximum flexibility is desired in the range of possible sampling frequencies, the following table shall be used to associate an implied sampling frequency with the desired sampling frequency dependent tables.

TABLE 1

Sampling frequency mapping

| Frequency range (in Hz) | Use tables for sampling frequency (in Hz) |
|---|---|
| f >= 92017 | 96000 |
| 92017 > f >= 75132 | 88200 |
| 75132 > f >= 55426 | 64000 |
| 55426 > f >= 46009 | 48000 |
| 46009 > f >= 37566 | 44100 |
| 37566 > f >= 27713 | 32000 |
| 27713 > f >= 23004 | 24000 |
| 23004 > f >= 18783 | 22050 |
| 18783 > f >= 13856 | 16000 |
| 13856 > f >= 11502 | 12000 |
| 11502 > f >= 9391 | 11025 |
| 9391 > f | 8000 |

UsacChannelConfig( )

The channel configuration table covers most common loudspeaker positions. For further flexibility channels can be mapped to an overall selection of 32 loudspeaker positions found in modern loudspeaker setups in various applications (see FIGS. 3*a*, 3*b*)

For each channel contained in the bitstream the UsacChannelConfig( ) specifies the associated loudspeaker position to which this particular channel shall be mapped. The loudspeaker positions which are indexed by bsOutputChannelPos are listed in FIG. 4*a*. In case of multiple channel elements the index i of bsOutputChannelPos[i] indicates the position in which the channel appears in the bitstream. Figure Y gives an overview over the loudspeaker positions in relation to the listener.

More precisely the channels are numbered in the sequence in which they appear in the bitstream starting with 0 (zero). In the trivial case of a UsacSingleChannelElement( ) or UsacLfeElement( ) the channel number is assigned to that channel and the channel count is increased by one. In case of a UsacChannelPairElement( ) the first channel in that element (with index ch==0) is numbered first, whereas the second channel in that same element (with index ch==1) receives the next higher number and the channel count is increased by two.

It follows that numOutChannels shall be equal to or smaller than the accumulated sum of all channels contained in the bitstream. The accumulated sum of all channels is equivalent to the number of all UsacSingleChannelElement( )s plus the number of all UsacLfeElement( )s plus two times the number of all UsacChannelPairElement( )s.

All entries in the array bsOutputChannelPos shall be mutually distinct in order to avoid double assignment of loudspeaker positions in the bitstream.

In the special case that channelConfigurationIndex is 0 and numOutChannels is smaller than the accumulated sum of all channels contained in the bitstream, then the handling of the non-assigned channels is outside of the scope of this specification. Information about this can e.g. be conveyed by appropriate means in higher application layers or by specifically designed (private) extension payloads.

UsacDecoderConfig( )

The UsacDecoderConfig( ) contains all further information necessitated by the decoder to interpret the bitstream. Firstly the value of sbrRatioIndex determines the ratio between core coder frame length (ccfl) and the output frame length. Following the sbrRatioIndex is a loop over all channel elements in the present bitstream. For each iteration the type of element is signaled in usacElementType[ ], immediately followed by its corresponding configuration structure. The order in which the various elements are present in the UsacDecoderConfig( ) shall be identical to the order of the corresponding payload in the UsacFrame( ).

Each instance of an element can be configured independently. When reading each channel element in UsacFrame( ), for each element the corresponding configuration of that instance, i.e. with the same elemIdx, shall be used.

UsacSingleChannelElementConfig( )

The UsacSingleChannelElementConfig( ) contains all information needed for configuring the decoder to decode one single channel. SBR configuration data is only transmitted if SBR is actually employed.

UsacChannelPairElementConfig( )

The UsacChannelPairElementConfig( ) contains core coder related configuration data as well as SBR configuration data depending on the use of SBR. The exact type of stereo coding algorithm is indicated by the stereoConfigIndex. In USAC a channel pair can be encoded in various ways. These are:

1. Stereo core coder pair using traditional joint stereo coding techniques, extended by the possibility of complex prediction in the MDCT domain
2. Mono core coder channel in combination with MPEG Surround based MPS212 for fully parametric stereo coding. Mono SBR processing is applied on the core signal.
3. Stereo core coder pair in combination with MPEG Surround based MPS212, where the first core coder channel carries a downmix signal and the second channel carries a residual signal. The residual may be band limited to realize partial residual coding. Mono SBR processing is applied only on the downmix signal before MPS212 processing.
4. Stereo core coder pair in combination with MPEG Surround based MPS212, where the first core coder channel carries a downmix signal and the second channel carries a residual signal. The residual may be band limited to realize partial residual coding. Stereo SBR is applied on the reconstructed stereo signal after MPS212 processing.

Option 3 and 4 can be further combined with a pseudo LR channel rotation after the core decoder.

UsacLfeElementConfig( )

Since the use of the time warped MDCT and noise filling is not allowed for LFE channels, there is no need to transmit the usual core coder flag for these tools. They shall be set to zero instead.

Also the use of SBR is not allowed nor meaningful in an LFE context. Thus, SBR configuration data is not transmitted.

UsacCoreConfig( )

The UsacCoreConfig( ) only contains flags to en- or disable the use of the time warped MDCT and spectral noise filling on a global bitstream level. If tw_mdct is set to zero, time warping shall not be applied. If noiseFilling is set to zero the spectral noise filling shall not be applied.

SbrConfig( )

The SbrConfig( ) bitstream element serves the purpose of signaling the exact eSBR setup parameters. On one hand the SbrConfig( ) signals the general employment of eSBR tools. On the other hand it contains a default version of the SbrHeader( ) the SbrDfltHeader( ) The values of this default header shall be assumed if no differing SbrHeader( ) is transmitted in the bitstream. The background of this mechanism is, that typically only one set of SbrHeader( ) values are applied in one bitstream. The transmission of the SbrDfltHeader( ) then allows to refer to this default set of values very efficiently by using only one bit in the bitstream. The possibility to vary the values of the SbrHeader on the fly is still retained by allowing the in-band transmission of a new SbrHeader in the bitstream itself.

SbrDfltHeader( )

The SbrDfltHeader( ) is what may be called the basic SbrHeader( ) template and should contain the values for the predominantly used eSBR configuration. In the bitstream this configuration can be referred to by setting the sbrUseDfltHeader flag. The structure of the SbrDfltHeader( ) is identical to that of SbrHeader( ). In order to be able to distinguish between the values of the SbrDfltHeader( ) and SbrHeader( ), the bit fields in the SbrDfltHeader( ) are prefixed with "dflt_" instead of "bs_". If the use of the SbrDfltHeader( ) is indicated, then the SbrHeader( ) bit fields shall assume the values of the corresponding SbrDfltHeader( ), i.e.

bs_start_freq=dflt_start_freq;

bs_stop_freq=dflt_stop_freq;

etc.

(continue for all elements in SbrHeader( ), like:

bs_xxx_yyy=dflt_xxx_yyy;

Mps212Config( )

The Mps212Config( ) resembles the SpatialSpecificConfig( ) of MPEG Surround and was in large parts deduced from that. It is however reduced in extent to contain only information relevant for mono to stereo upmixing in the USAC context. Consequently MPS212 configures only one OTT box.

UsacExtElementConfig( )

The UsacExtElementConfig( ) is a general container for configuration data of extension elements for USAC. Each USAC extension has a unique type identifier, usacExtElementType, which is defined in FIG. 6*k*. For each UsacExtElementConfig( ) the length of the contained extension configuration is transmitted in the variable usacExtElementConfigLength and allows decoders to safely skip over extension elements whose usacExtElementType is unknown.

For USAC extensions which typically have a constant payload length, the UsacExtElementConfig( ) allows the transmission of a usacExtElementDefaultLength. Defining a default payload length in the configuration allows a highly efficient signaling of the usacExtElementPayloadLength inside the UsacExtElement( ), where bit consumption needs to be kept low.

In case of USAC extensions where a larger amount of data is accumulated and transmitted not on a per frame basis but only every second frame or even more rarely, this data may be transmitted in fragments or segments spread over several USAC frames. This can be helpful in order to keep the bit reservoir more equalized. The use of this mechanism is signaled by the flag usacExtElementPayloadFrag flag. The fragmentation mechanism is further explained in the description of the usacExtElement in 6.2.X.

UsacConfigExtension( )

The UsacConfigExtension( ) is a general container for extensions of the UsacConfig( ). It provides a convenient way to amend or extend the information exchanged at the time of the decoder initialization or set-up. The presence of config extensions is indicated by usacConfigExtensionPresent. If config extensions are present (usacConfigExtensionPresent==1), the exact number of these extensions follows in the bit field numConfigExtensions. Each configuration extension has a unique type identifier, usacConfigExtType. For each UsacConfigExtension the length of the contained configuration extension is transmitted in the variable usacConfigExtLength and allows the configuration bitstream parser to safely skip over configuration extensions whose usacConfigExtType is unknown.

Top Level Payloads for the Audio Object Type USAC

TERMS AND DEFINITIONS

UsacFrame( ) This block of data contains audio data for a time period of one USAC frame, related information and other data. As signaled in UsacDecoderConfig( ), the UsacFrame( ) contains numElements elements. These elements can contain audio data, for one or two channels, audio data for low frequency enhancement or extension payload.

UsacSingleChannelElement( ) Abbreviation SCE. Syntactic element of the bitstream containing coded data for a single audio channel. A single_channel_element( ) basically consists of the UsacCoreCoderData( ), containing data for either FD or LPD core coder. In case SBR is active, the UsacSingleChannelElement also contains SBR data.

UsacChannelPairElement( ) Abbreviation CPE. Syntactic element of the bitstream payload containing data for a pair of channels. The channel pair can be achieved either by transmitting two discrete channels or by one discrete channel and related Mps212 payload. This is signaled by means of the stereoConfigIndex. The UsacChannelPairElement further contains SBR data in case SBR is active.

UsacLfeElement( ) Abbreviation LFE. Syntactic element that contains a low sampling frequency enhancement channel. LFEs are encoded using the fd_channel_stream( ) element.

UsacExtElement( ) Syntactic element that contains extension payload. The length of an extension element is either signaled as a default length in the configuration (USACExtElementConfig( )) or signaled in the UsacExtElement( ) itself. If present, the extension payload is of type usacExtElementType, as signaled in the configuration.

usacIndependencyFlag indicates if the current UsacFrame( ) can be decoded entirely without the knowledge of information from previous frames according to the Table below

TABLE

Meaning of usacIndependencyFlag

| value of usacIndependencyFlag | Meaning |
|---|---|
| 0 | Decoding of data conveyed in UsacFrame( ) might necessitate access to the previous UsacFrame( ). |
| 1 | Decoding of data conveyed in UsacFrame( ) is possible without access to the previous UsacFrame( ). |

NOTE:

Please refer to X.Y for recommendations on the use of the usacIndependencyFlag.

usacExtElementUseDefaultLength indicates whether the length of the extension element corresponds to usacExtElementDefaultLength, which was defined in the UsacExtElementConfig( ).

usacExtElementPayloadLength shall contain the length of the extension element in bytes. This value should only be explicitly transmitted in the bitstream if the length of the extension element in the present access unit deviates from the default value, usacExtElementDefaultLength.

usacExtElementStart Indicates if the present usacExtElementSegmentData begins a data block.

usacExtElementStop Indicates if the present usacExtElementSegmentData ends a data block.

usacExtElementSegmentData The concatenation of all usacExtElementSegmentData from UsacExtElement( ) of consecutive USAC frames, starting from the UsacExtElement( ) with usacExtElementStart==1 up to and including the UsacExtElement( ) with usacExtElementStop==1 forms one data block. In case a complete data block is contained in one UsacExtElement( ), usacExtElementStart and usacExtElementStop shall both be set to 1. The data blocks are interpreted as a byte aligned extension payload depending on usacExtElementType according to the following Table:

TABLE

Interpretation of data blocks for USAC extension payload decoding

| usacExtElementType | The concatenated usacExtElementSegmentData represents: |
|---|---|
| ID_EXT_ELE_FIL | Series of fill_byte |
| ID_EXT_ELE_MPEGS | SpatialFrame( ) |
| ID_EXT_ELE_SAOC | SaocFrame( ) |
| unknown | unknown data. The data block shall be discarded. |

fill_byte Octet of bits which may be used to pad the bitstream with bits that carry no information. The exact bit pattern used for fill_byte should be '10100101'.

Helper Elements nrCoreCoderChannels In the context of a channel pair element this variable indicates the number of core coder channels which form the basis for stereo coding. Depending on the value of stereoConfigIndex this value shall be 1 or 2.

nrSbrChannels In the context of a channel pair element this variable indicates the number of channels on which SBR processing is applied. Depending on the value of stereoConfigIndex this value shall be 1 or 2.

Subsidiary Payloads for USAC

TERMS AND DEFINITIONS

UsacCoreCoderData( ) This block of data contains the core-coder audio data. The payload element contains data for one or two core-coder channels, for either FD or LPD mode. The specific mode is signaled per channel at the beginning of the element.

StereoCoreToolInfo( ) All stereo related information is captured in this element. It deals with the numerous dependencies of bits fields in the stereo coding modes.

Helper Elements commonCoreMode in a CPE this flag indicates if both encoded core coder channels use the same mode.

Mps212Data( ) This block of data contains payload for the Mps212 stereo module. The presence of this data is dependent on the stereoConfigIndex.

common_window indicates if channel 0 and channel 1 of a CPE use identical window parameters.

common_tw indicates if channel 0 and channel 1 of a CPE use identical parameters for the time warped MDCT.

Decoding of UsacFrame( )

One UsacFrame( ) forms one access unit of the USAC bitstream. Each UsacFrame decodes into 768, 1024, 2048 or 4096 output samples according to the outputFrameLength determined from a Table.

The first bit in the UsacFrame( ) is the usacIndependencyFlag, which determines if a given frame can be decoded without any knowledge of the previous frame. If the usacIndependencyFlag is set to 0, then dependencies to the previous frame may be present in the payload of the current frame.

The UsacFrame( ) is further made up of one or more syntactic elements which shall appear in the bitstream in the same order as their corresponding configuration elements in the UsacDecoderConfig( ). The position of each element in the series of all elements is indexed by elemIdx. For each element the corresponding configuration, as transmitted in the UsacDecoderConfig( ) of that instance, i.e. with the same elemIdx, shall be used.

These syntactic elements are of one of four types, which are listed in a Table. The type of each of these elements is determined by usacElementType. There may be multiple elements of the same type. Elements occurring at the same position elemIdx in different frames shall belong to the same stream.

TABLE

Examples of simple possible bitstream payloads

| | numElements | elemIdx | usacElementType[elemIdx] |
|---|---|---|---|
| mono output signal | 1 | 0 | ID_USAC_SCE |
| stereo output signal | 1 | 0 | ID_USAC_CPE |
| 5.1 channel output signal | 4 | 0 | ID_USAC_SCE |
| | | 1 | ID_USAC_CPE |
| | | 2 | ID_USAC_CPE |
| | | 3 | ID_USAC_LFE |

If these bitstream payloads are to be transmitted over a constant rate channel then they might include an extension payload element with an usacExtElementType of ID_EXT_ELE_FILL to adjust the instantaneous bitrate. In this case an example of a coded stereo signal is:

TABLE

Examples of simple stereo bitstream with extension payload for writing fill bits.

| | numElements | elemIdx | usacElementType[elemIdx] |
|---|---|---|---|
| stereo output signal | 2 | 0 | ID_USAC_CPE |
| | | 1 | ID_USAC_EXT with usacExtElementType== ID_EXT_ELE_FILL |

Decoding of UsacSingleChannelElement( )

The simple structure of the UsacSingleChannelElement( ) is made up of one instance of a UsacCoreCoderData( ) element with nrCoreCoderChannels set to 1. Depending on the sbrRatioIndex of this element a UsacSbrData( ) element follows with nrSbrChannels set to 1 as well.

Decoding of UsacExtElement( )

UsacExtElement( ) structures in a bitstream can be decoded or skipped by a USAC decoder. Every extension is identified by a usacExtElementType, conveyed in the UsacExtElement( )'s associated UsacExtElementConfig( ). For each usacExtElementType a specific decoder can be present.

If a decoder for the extension is available to the USAC decoder then the payload of the extension is forwarded to the extension decoder immediately after the UsacExtElement( ) has been parsed by the USAC decoder.

If no decoder for the extension is available to the USAC decoder, a minimum of structure is provided within the bitstream, so that the extension can be ignored by the USAC decoder.

The length of an extension element is either specified by a default length in octets, which can be signaled within the corresponding UsacExtElementConfig( ) and which can be overruled in the UsacExtElement( ), or by an explicitly provided length information in the UsacExtElement( ), which is either one or three octets long, using the syntactic element escapedValue( ).

Extension payloads that span one or more UsacFrame( ) can be fragmented and their payload be distributed among several UsacFrame( ). In this case the usacExtElementPayloadFrag flag is set to 1 and a decoder has to collect all fragments from the UsacFrame( ) with usacExtElementStart set to 1 up to and including the UsacFrame( ) with usacExtElementStop set to 1. When usacExtElementStop is set to 1 then the extension is considered to be complete and is passed to the extension decoder.

Note that Integrity Protection for a Fragmented Extension Payload is not Provided by this SpecifiCation and Other Means should be Used to Ensure Completeness of Extension Payloads. Note, that all Extension Payload Data is Assumed to be Byte-Aligned.

Each UsacExtElement( ) shall obey the requirements resulting from the use of the usacIndependencyFlag. Put more explicitly, if the usacIndependencyFlag is set (==1) the UsacExtElement( ) shall be decodable without knowledge of the previous frame (and the extension payload that may be contained in it).

Decoding Process

The stereoConfigIndex, which is transmitted in the UsacChannelPairElementConfig( ) determines the exact type of stereo coding which is applied in the given CPE. Depending on this type of stereo coding either one or two core coder channels are actually transmitted in the bitstream and the variable nrCoreCoderChannels needs to be set accordingly. The syntax element UsacCoreCoderData( ) then provides the data for one or two core coder channels.

Similarly the there may be data available for one or two channels depending on the type of stereo coding and the use of eSBR (ie. if sbrRatioIndex>0). The value of nrSbrChannels needs to be set accordingly and the syntax element UsacSbrData( ) provides the eSBR data for one or two channels.

Finally Mps212Data( ) is transmitted depending on the value of stereoConfigIndex.

Low Frequency Enhancement (LFE) Channel Element, UsacLfeElement( )

General

In order to maintain a regular structure in the decoder, the UsacLfeElement( ) is defined as a standard fd_channel_stream(0,0,0,0,x) element, i.e. it is equal to a UsacCoreCoderData( ) using the frequency domain coder. Thus, decoding can be done using the standard procedure for decoding a UsacCoreCoderData( )-element.

In order to accommodate a more bitrate and hardware efficient implementation of the LFE decoder, however, several restrictions apply to the options used for the encoding of this element:

- The window_sequence field is set to 0 (ONLY_LONG_SEQUENCE)
- Only the lowest 24 spectral coefficients of any LFE may be non-zero
- No Temporal Noise Shaping is used, i.e. tns_data_present is set to 0
- Time warping is not active
- No noise filling is applied UsacCoreCoderData( )

The UsacCoreCoderData( ) contains all information for decoding one or two core coder channels.

The order of decoding is:

- get the core_mode[ ] for each channel
- in case of two core coded channels (nrChannels==2), parse the StereoCoreToolInfo( ) and determine all stereo related parameters
- Depending on the signaled core_modes transmit an lpd_channel_stream( ) or an fd_channel_stream( ) for each channel As can be seen from the above list, the decoding of one core coder channel (nrChannels==1) results in obtaining the core_mode bit followed by one lpd_channel_stream or fd_channel_stream, depending on the core_mode.

In the two core coder channel case, some signaling redundancies between channels can be exploited in particular if the core_mode of both channels is 0. See 6.2.X (Decoding of StereoCoreToolInfo( )) for details StereoCoreToolInfo( )

The StereoCoreToolInfo( ) allows to efficiently code parameters, whose values may be shared across core coder channels of a CPE in case both channels are coded in FD mode (core_mode[0,1]==0). In particular the following data elements are shared, when the appropriate flag in the bitstream is set to 1.

TABLE

Bitstream elements shared across channels of a core coder channel pair

| common_xxx flag is set to 1 | channels 0 and 1 share the following elements: |
|---|---|
| common_window | ics_info( ) |
| common_window && common_max_sfb | max_sfb |
| common_tw | tw_data( ) |
| common_tns | tns_data( ) |

If the appropriate flag is not set then the data elements are transmitted individually for each core coder channel either in StereoCoreToolInfo( ) (max_sfb, max_sfb1) or in the fd_channel_stream( ) which follows the StereoCoreToolInfo( ) in the UsacCoreCoderData( ) element.

In case of common_window==1 the StereoCoreToolInfo( ) also contains the information about M/S stereo coding and complex prediction data in the MDCT domain (see 7.7.2).

UsacSbrData( ) This block of data contains payload for the SBR bandwidth extension for one or two channels. The presence of this data is dependent on the sbrRatioIndex.

SbrInfo( ) This element contains SBR control parameters which do not necessitate a decoder reset when changed.

SbrHeader( ) This element contains SBR header data with SBR configuration parameters, that typically do not change over the duration of a bitstream.

SBR Payload for USAC

In USAC the SBR payload is transmitted in UsacSbrData( ), which is an integral part of each single channel element or channel pair element. UsacSbrData( ) follows immediately UsacCoreCoderData( ). There is no SBR payload for LFE channels.

numSlots The number of time slots in an Mps212Data frame.

FIG. 1 illustrates an audio decoder for decoding an encoded audio signal provided at an input 10. On the input line 10, there is provided the encoded audio signal which is, for example, a data stream or, even more exemplarily, a serial data stream. The encoded audio signal comprises a first channel element and a second channel element in the payload section of the data stream and first decoder configuration data for the first channel element and second decoder configuration data for the second channel element in a configuration section of the data stream. Typically, the first decoder configuration data will be different from the second decoder configuration data, since the first channel element will also typically be different from the second channel element.

The data stream or encoded audio signal is input into a data stream reader 12 for reading the configuration data for each channel element and forwarding same to a configuration controller 14 via a connection line 13. Furthermore, the data stream reader is arranged for reading the payload data for each channel element in the payload section and this payload data comprising the first channel element and the second channel element is provided to a configurable decoder 16 via a connection line 15. The configurable decoder 16 is arranged for decoding the plurality of channel elements in order to output data for the individual channel elements as indicated at output lines 18*a*, 18*b*. Particularly, the configurable decoder 16 is configured in accordance with the first decoder configuration data when decoding the first channel element and in accordance with the second configuration data when decoding the second channel element. This is indicated by the connection lines 17*a*, 17*b*, where connection line 17*a* transports the first decoder configuration data from the configuration controller 14 to the configurable decoder and connecting line 17*b* transports the second decoder configuration data from the configuration controller to the configurable decoder. The configuration controller will be implemented in any way in order to make the configurable decoder to operate in accordance with the decoder configuration signaled in the corresponding decoder configuration data or on the corresponding line 17*a*, 17*b*. Hence, the configuration controller 14 can be implemented as an interface between the data stream reader 12 which actually gets the configuration data from the data stream and the configurable decoder 16 which is configured by the actually read configuration data.

Figure 2:
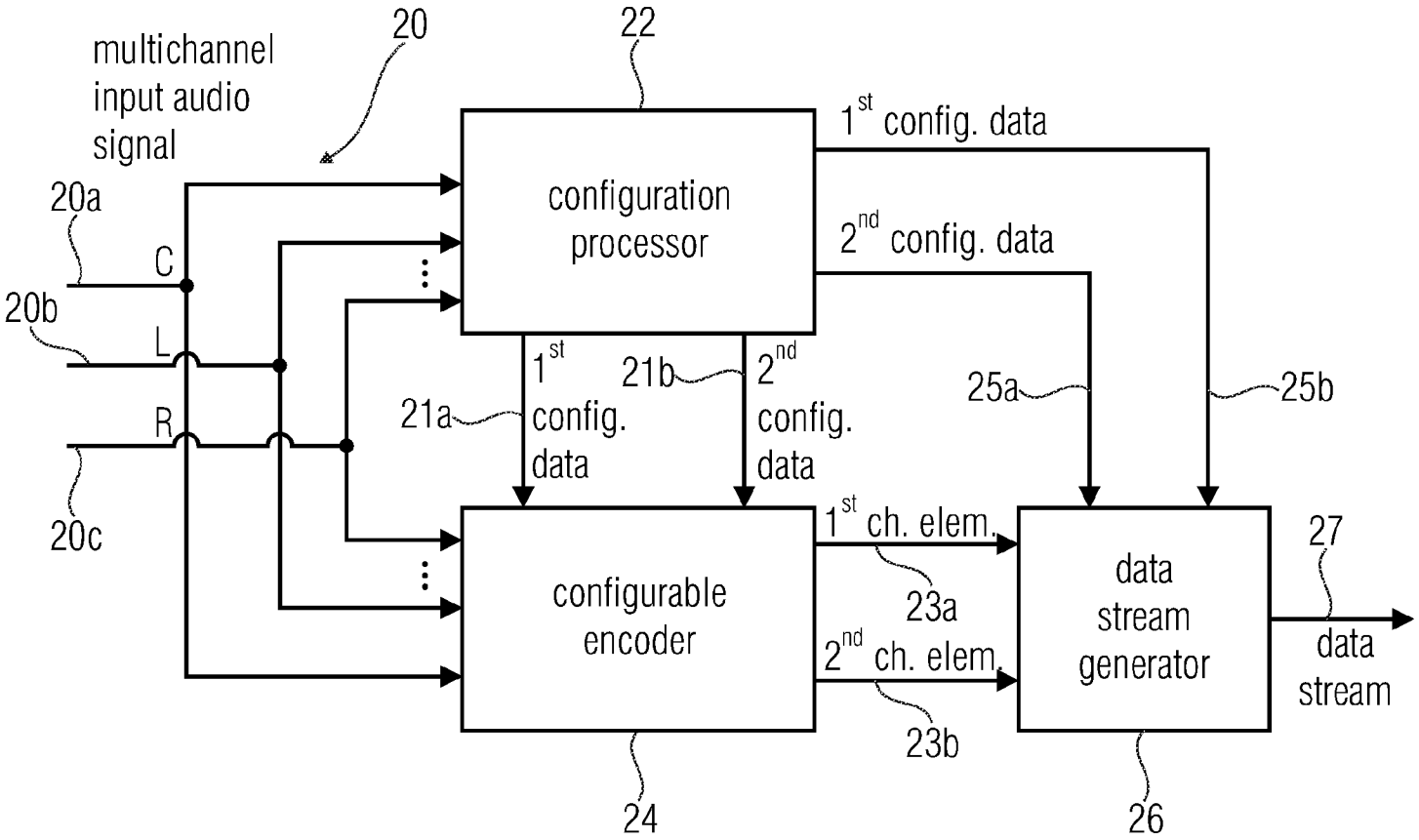
FIG. 2 is a block diagram of an encoder.

FIG. 2 illustrates a corresponding audio encoder for encoding a multi-channel input audio signal provided at an input 20. The input 20 is illustrated as comprising three different lines 20*a*, 20*b*, 20*c*, where line 20*a* carries, for example, a center channel audio signal, line 20*b* carries a left channel audio signal and line 20*c* carries a right channel audio signal. All three channel signals are input into a configuration processor 22 and a configurable encoder 24. The configuration processor is adapted for generating first configuration data on line 21*a* and second configuration data on line 21*b* for a first channel element, for example comprising only the center channel so that the first channel element is a single channel element, and for a second channel element which is, for example, a channel pair element carrying the left channel and the right channel. The configurable encoder 24 is adapted for encoding the multi-channel audio signal 20 to obtain the first channel element 23*a* and the second channel element 23*b* using the first configuration data 21*a* and the second configuration data 21*b*. The audio encoder additionally comprises a data stream generator 26 which receives, at input lines 25*a* and 25*b*, the first configuration data and the second configuration data and which receives, additionally, the first channel element 23*a* and the second channel element 23*b*. The data stream generator 26 is adapted for generating a data stream 27 representing an encoded audio signal, the data stream having a configuration section having the first and the second configuration data and a payload section comprising the first channel element and the second channel element.

In this context, it is outlined that the first configuration data and the second configuration data can be identical to the first decoder configuration data or the second decoder configuration data or can be different. In the latter case, the configuration controller 14 is configured to transform the configuration data in the data stream, when the configuration data is an encoderdirected data, into corresponding decoder-directed data by applying, for example, unique functions or lookup tables or so. However, it is advantageous that the configuration data written into the data stream is already a decoder configuration data so that the configurable encoder 24 or the configuration processor 22 have, for example, a functionality for deriving encoder configuration data from calculated decoder configuration data or for calculating or determining decoder configuration data from calculated encoder configuration data again by applying unique functions or lookup tables or other pre-knowledge.

Figure 5A:
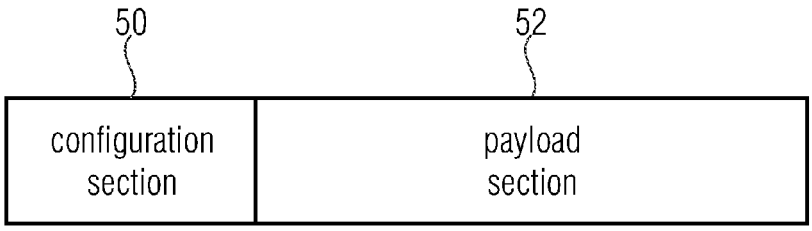
FIGS. 5*a* to 5*d* illustrate different aspects of the encoded audio signal having a configuration section and the payload section.
Figure 5B:
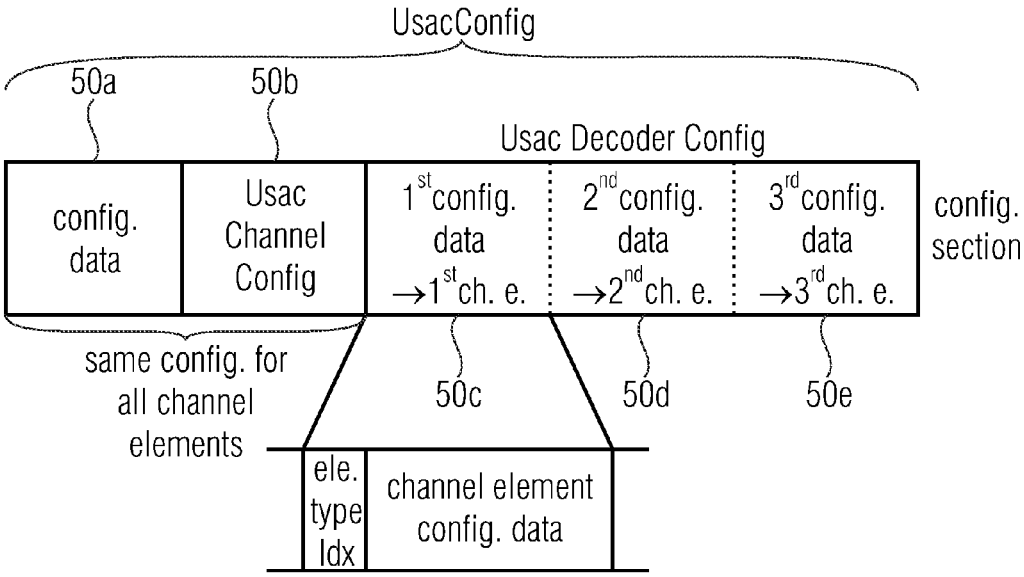

FIG. 5*a* illustrates a general illustration of the encoded audio signal input into the data stream reader 12 of FIG. 1 or output by the data stream generator 26 of FIG. 2. The data stream comprises a configuration section 50 and a payload section 52. FIG. 5*b* illustrates a more detailed implementation of the configuration section 50 in FIG. 5*a*. The data stream illustrated in FIG. 5*b* which is typically a serial data stream carrying one bit after the other comprises, at its first portion 50*a*, general configuration data relating to higher layers of the transport structure such as an MPEG-4 file format. Alternatively or additionally, the configuration data 50*a*, which may be there or may not be there comprises additional general configuration data included in the UsacChannelConfig illustrated at 50*b*.

Generally, the configuration data 50*a* can also comprise the data from UsacConfig illustrated in FIG. 6*a*, and item 50*b* comprises the elements implemented and illustrated in the UsacChannelConfig of FIG. 6*b*. Particularly, the same configuration for all channel elements may, for example, comprise the output channel indication illustrated and described in the context of FIGS. 3*a*, 3*b* and FIGS. 4*a*, 4*b*.

Then, the configuration section 50 of the bitstream is followed by the UsacDecoderConfig element which is, in this example, formed by a first configuration data 50*c*, a second configuration data 50*d* and a third configuration data 50*e*. The first configuration data 50*c* is for the first channel element, the second configuration data 50*d* is for the second channel element, and the third configuration data 50*e* is for the third channel element.

Particularly, as outlined in FIG. 5*b*, each configuration data for the channel element comprises an identifier element type idx which is, with respect to its syntax, used in FIG. 6*c*.

Then, the element type index idx which has two bits is followed by the bits describing the channel element configuration data found in FIG. 6*c* and further explained in FIG. 6*d* for the single channel element, FIG. 6*e* for the channel pair element, FIG. 6*f* for the LFE element and FIG. 6*k* for the extension element which are all channel elements that can typically be included in the USAC bitstream.

Figure 5C:
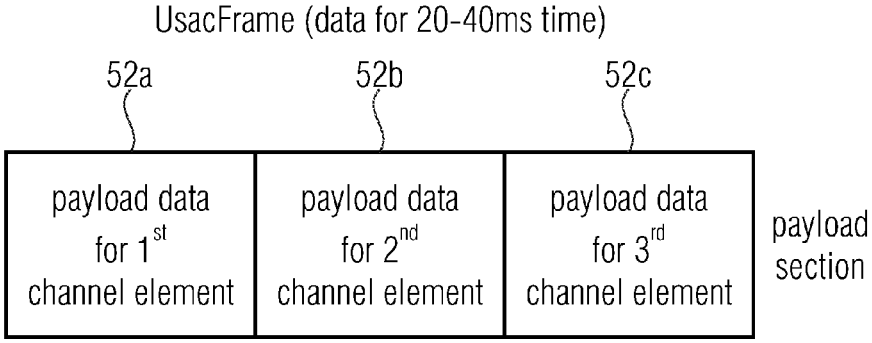

FIG. 5*c* illustrates a USAC frame comprised in the payload section 52 of a bitstream illustrated in FIG. 5*a*. When the configuration section in FIG. 5*b* forms the configuration section 50 of FIG. 5*a*, i.e., when the payload section comprises three channel elements, then the payload section 52 will be implemented as outlined in FIG. 5*c*, i.e., that the payload data for the first channel element 52*a* is followed by the payload data for the second channel element indicated by 52*b* which is followed by the payload data 52*c* for the third channel element. Hence, in accordance with the present invention, the configuration section and the payload section are organized in such a way that the configuration data is in the same order with respect to the channel elements as the payload data with respect to the channel elements in the payload section. Hence, when the order in the UsacDecoderConfig element is configuration data for the first channel element, configuration data for the second channel element, configuration data for the third channel element, then the order in the payload section is the same, i.e., there is the payload data for the first channel element, then follows the payload data for the second channel element and then follows the payload data for the third channel element in a serial data or bit stream.

This parallel structure in the configuration section and the payload section is advantageous due to the fact that it allows an easy organization with extremely low overhead signaling regarding which configuration data belongs to which channel element. In the conventional technology, any ordering was not necessitated since the individual configuration data for channel elements did not exist. However, in accordance with the present invention individual configuration data for individual channel elements is introduced in order to make sure that the optimum configuration data for each channel element can be optimally selected.

Figure 5D:
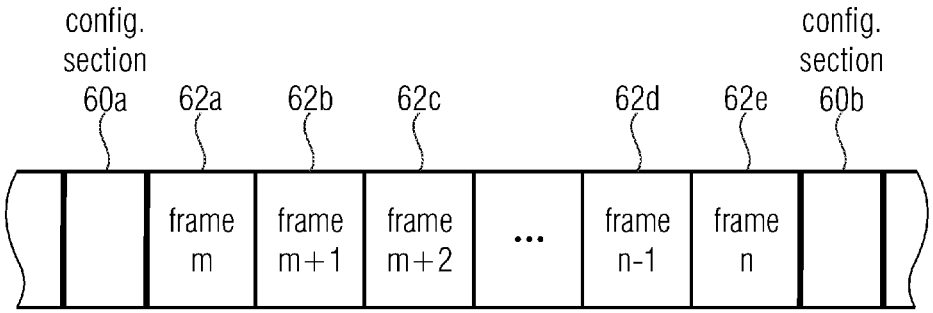

Typically, a USAC frame comprises data for 20 to 40 milliseconds worth of time. When a longer data stream is considered, as illustrated in FIG. 5*d*, then there is a configuration section 60*a* followed by payload sections or frames 62*a*, 62*b*, 62*c*, . . . , 62*e*, then a configuration section 62*d* is, again, included in the bitstream.

The order of configuration data in the configuration section is, as discussed with respect to FIGS. 5*b* and 5*c*, the same as the order of the channel element payload data in each of the frames 62*a* to 62*e*. Therefore, also the order of the payload data for the individual channel elements is exactly the same in each frame 62*a* to 62*e*.

Generally, when the encoded signal is a single file stored on a hard disk, for example, then a single configuration section 50 is sufficient at the beginning of the whole audio track such as a 10 minutes or 20 minutes or so track. Then, the single configuration section is followed by a high number of individual frames and the configuration is valid for each frame and the order of the channel element data (configuration or payload) is also the same in each frame and in the configuration section.

However, when the encoded audio signal is a stream of data, it is necessitated to introduce configuration sections between individual frames in order to provide access points so that a decoder can start decoding even when an earlier configuration section has already been transmitted and has not been received by the decoder since the decoder was not yet switched on to receive the actual data stream. The number n of frames between different configuration sections, however, is arbitrarily selectable but when one would like to achieve an access point each second, then the number of frames between two configuration sections will be between 25 and 50.

Subsequently, FIG. 7 illustrates a straightforward example for encoding and decoding a 5.1 multi-channel signal.

Advantageously, four channel elements are used, where the first channel element is a single channel element comprising the center channel, the second channel element is a channel pair element CPE1 comprising the left channel and the right channel and the third channel element is a second channel pair element CPE2 comprising the left surround channel and the right surround channel. Finally, the fourth channel element is an LFE channel element. In an embodiment, for example, the configuration data for the single channel element would be so that the noise filling tool is on while, for example, for the second channel pair element comprising the surround channels, the noise filling tool is off and the parametric stereo coding procedure is applied which is a low quality, but low bitrate stereo coding procedure resulting in a low bitrate but the quality loss may not be problematic due to the fact that the channel pair element has the surround channels.

On the other hand, the left and right channels comprise a significant amount of information and, therefore, a high quality stereo coding procedure is signaled by the MPS212 configuration. The M/S stereo coding is advantageous in that it provides a high quality but is problematic in that the bitrate is quite high. Therefore, M/S stereo coding is advantageous for the CPE1 but is not advantageous for the CPE2. Furthermore, depending on the implementation, the noise filling feature can be switched on or off and is switched on due to the fact that a high emphasis is made to have a good and high quality representation of the left and right channels as well as for the center channel where the noise filling is on as well.

However, when the core bandwidth of the channel element C is, for example, quite low and the number of successive lines quantized to zero in the center channel is also low, then it can also be useful to switch off noise filling for the center channel single channel element due to the fact that the noise filling does not provide additional quality gains and the bits necessitated for transmitting the side information for the noise filling tool can then be saved in view of no or only a minor quality increase.

Generally, the tools signaled in the configuration section for a channel element are the tools mentioned in, for example, FIG. 6*d*, 6*e*, 6*f*, 6*g*, 6*h*, 6*i*, 6*j* and additionally comprise the elements for the extension element configuration in FIGS. 6*k*, 6*l* and 6*m*. As outlined in FIG. 6*e*, the MPS212 configuration can be different for each channel element.

MPEG surround uses a compact parametric representation of the human's auditory cues for spatial perception to allow for a bit-rate efficient representation of a multichannel signal. In addition to CLD and ICC parameters, IPD parameters can be transmitted. The OPD parameters are estimated with given CLD and IPD parameters for efficient representation of phase information. IPD and OPD parameters are used to synthesize the phase difference to further improve stereo image.

In addition to the parametric mode, residual coding can be employed with the residual having a limited or full bandwidth. In this procedure, two output signals are generated by mixing a mono input signal and a residual signal using the CLD, ICC and IPD parameters. Additionally, all the parameters mentioned in FIG. 6*j* can be individually selected for each channel element. The individual parameters are, for example, explained in detail in ISO/IEC CD 23003-3 dated Sep. 24, 2010 which has been incorporated herein by reference.

Additionally, as outlined in FIGS. 6*f* and 6*g*, core features such as the time warping feature and the noise filling feature can be switched on or off for each channel element individually. The time warping tool described under the term "time-warped filter bank and block switching" in the above referenced document replaces the standard filter bank and block switching. In addition to the IMDCT, the tool contains a time-domain to time-domain mapping from an arbitrarily spaced grid to the normal linearly spaced time grid and a corresponding adaption of the window shapes.

Additionally, as outlined in FIG. 7, the noise filling tool can be switched on or off for each channel element individually. In low bitrate coding, noise filling can be used for two purposes. Course quantization of spectral values in low bitrate audio coding might lead to very sparse spectra after inverse quantization, as many spectral lines might have been quantized to zero. The sparse populated spectra will result in the decoded signal sounding sharp or unstable (birdies). By replacing the zero lines with the "small" values in the decoder it is possible to mask or reduce these very obvious artifacts without adding obvious new noise artifacts.

If there are noise like signal parts in the original spectrum, a perceptually equivalent representation of these noisy signal parts can be reproduced in the decoder based on only few parametric information like the energy of the noises signal part. The parametric information can be transmitted with few bits compared to the number of bits needed to transmit the coded wave form. Specifically, the data elements needed to transmit are the noise-offset element which is an additional offset to modify the scale factor of bands quantized to zero and the noise-level which is an integer representing the quantization noise to be added for every spectral line quantized to zero.

As outlined in FIG. 7 and FIGS. 6*f* and 6*g*, this feature can be switched on and off for each channel element individually.

Additionally, there are SBR features which can now be signaled for each channel element individually.

As outlined in FIG. 6*h*, these SBR elements comprise the switching on/off of different tools in SBR. The first tool to be switched on or off for each channel element individually is harmonic SBR. When harmonic SBR is switched on, the harmonic SBR pitching is performed while, when harmonic SBR is switched off, a pitching with consecutive lines as known from MPEG-4 (high efficiency) is used.

Furthermore, the PVC or "predictive vector coding" decoding process can be applied. In order to improve the subjective quality of the eSBR tool, in particular for speech content at low bitrates, predictive vector coding (PVC is added to the eSBR tool). Generally, for a speech signal, there is a relatively high correlation between the spectral envelopes of low frequency bands and high frequency bands. In the PVC scheme this is exploited by the prediction of the spectral envelopes in high frequency bands from the spectral envelopes in low frequency bands, where the coefficient matrices for the prediction are coded by means of vector quantization. The HF envelope adjuster is modified to process the envelopes generated by the PVC decoder.

The PVC tool can therefore be particularly useful for the single channel element where there is, for example, speech in the center channel, while the PVC tool is not useful, for example, for the surround channels of CPE2 or the left and right channels of CPEL Furthermore, the inter time envelope shaping feature (inter-Tes) can be switched on or off for each channel element individually. The inter-subband-sample temporal envelope shaping (inter-Tes) processes the QMF subband samples subsequent to the envelope adjuster. This module shapes the temporal envelope of the higher frequency bandwidth finer temporal granularity than that of the envelop adjuster. By applying a gain factor to each QMF subband sample in an SBR envelope, inter-Tes shapes the temporal envelope among the QMF subband samples. Inter-Tes consist of three modules, i.e., lower frequency inter-subband sample temporal envelope calculator, inter-subband-sample temporal envelope adjuster and inter-subband-sample temporal envelope shaper. Due to the fact that this tool necessitates additional bits, there will be channel elements where this additional bit consumption is not justified in view of the quality gain and where this additional bit consumption is justified in view of the quality gain. Therefore, in accordance with the present invention, a channel-element wise activation/deactivation of this tool is used.

Furthermore, FIG. 6*i* illustrates the syntax of the SBR default header and all SBR parameters in SBR default header mentioned in FIG. 6*i* can be selected different for each channel element. This, for example, relates to the start frequency or stop frequency actually setting the cross-over frequency, i.e., the frequency at which the reconstruction of the signal changes away from mode into parametric mode. Other features such as the frequency resolution and the noise band resolution etc., are also available for setting for each individual channel element selectively.

Hence, as outlined in FIG. 7, it is advantageous to individually set configuration data for stereo features, for core coder features and for SBR features. Individual setting of elements not only refers to the SBR parameters in the SBR default header as illustrated in FIG. 6*i* but also applies to all parameters in SbrConfig as outlined in FIG. 6*h*.

Subsequently, reference is made to FIG. 8 for illustrating an implementation of the decoder of FIG. 1.

In particular, the functionalities of the data stream reader 12 and the configuration controller 14 are similar as discussed in the context of FIG. 1. However, the configurable decoder 16 is now implemented, for example, for individual decoder instances where each decoder instance has an input for configuration data C provided by the configuration controller 14 and an input for data D for receiving the corresponding channel elements data from the data stream reader 12.

Figure 8:
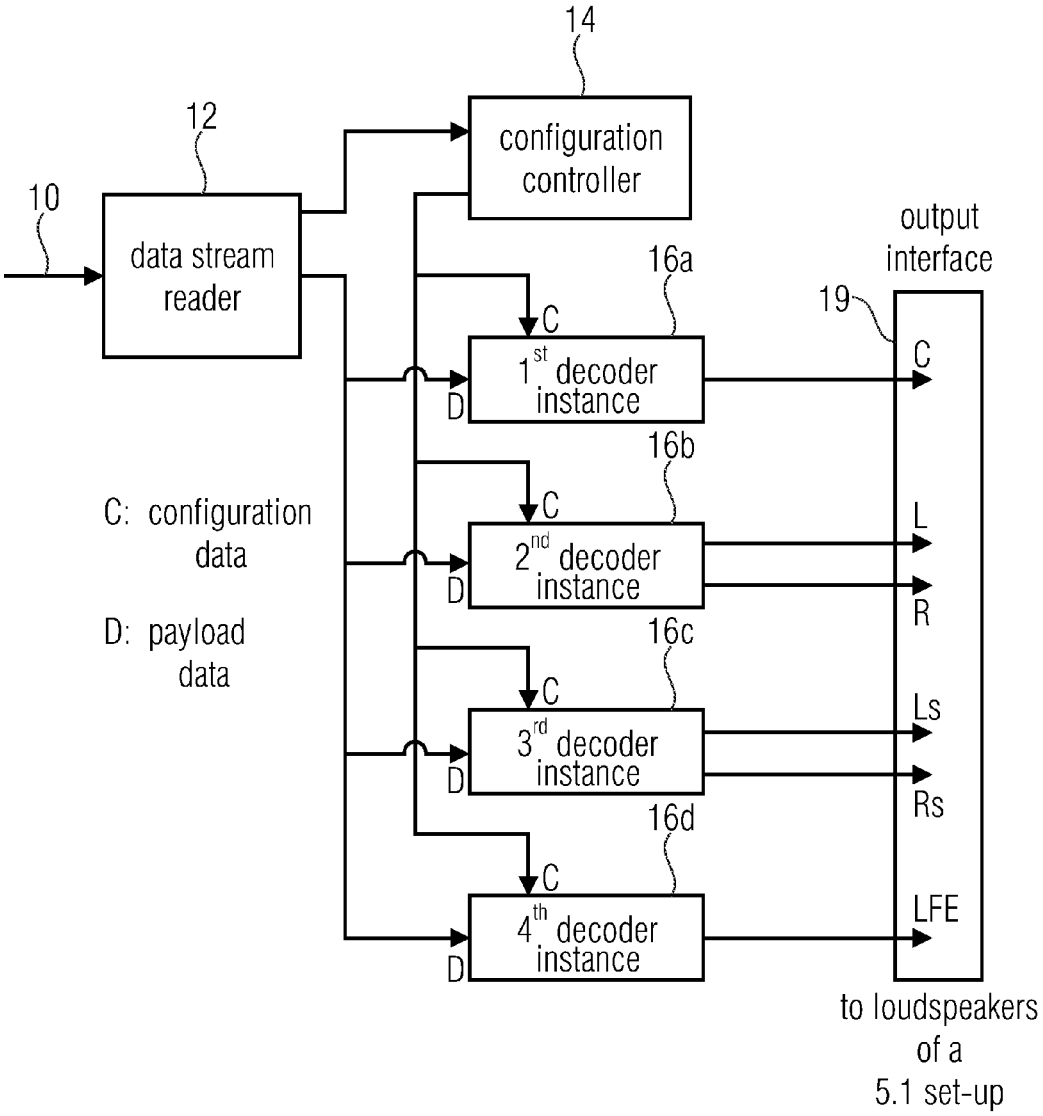
FIG. 8 illustrates an embodiment of a decoder implementation having parallely operating decoder instances for generating a 5.1 multi-channel audio signal.

In particular, the functionality of FIG. 8 is so that, for each individual channel element, an individual decoder instant is provided. Hence, the first decoder instance is configured by the first configuration data as, for example, a single channel element for the center channel.

Furthermore, the second decoder instance is configured in accordance with the second decoder configuration data for the left and right channels of a channel pair element. Furthermore, the third decoder instance 16*c* is configured for a further channel pair element comprising the left surround channel and the right surround channel. Finally, the fourth decoder instance is configured for the LFE channel. Hence, the first decoder instance provides, as an output, a single channel C. The second and third decoder instances 16*b*, 16*c*, however, each provide two output channels, i.e., left and right on the one hand and left surround and right surround on the other hand. Finally, the fourth decoder instance 16*d* provides, as an output, the LFE channel. All these six channels of the multi-channel signal are forwarded to an output interface 19 by the decoder instances and are then finally sent out for storage, for example, or for replay in a 5.1 loudspeaker setup, for example. It is clear that different decoder instances and a different number of decoder instances are necessitated when the loudspeaker setup is a different loudspeaker setup.

Figure 9:
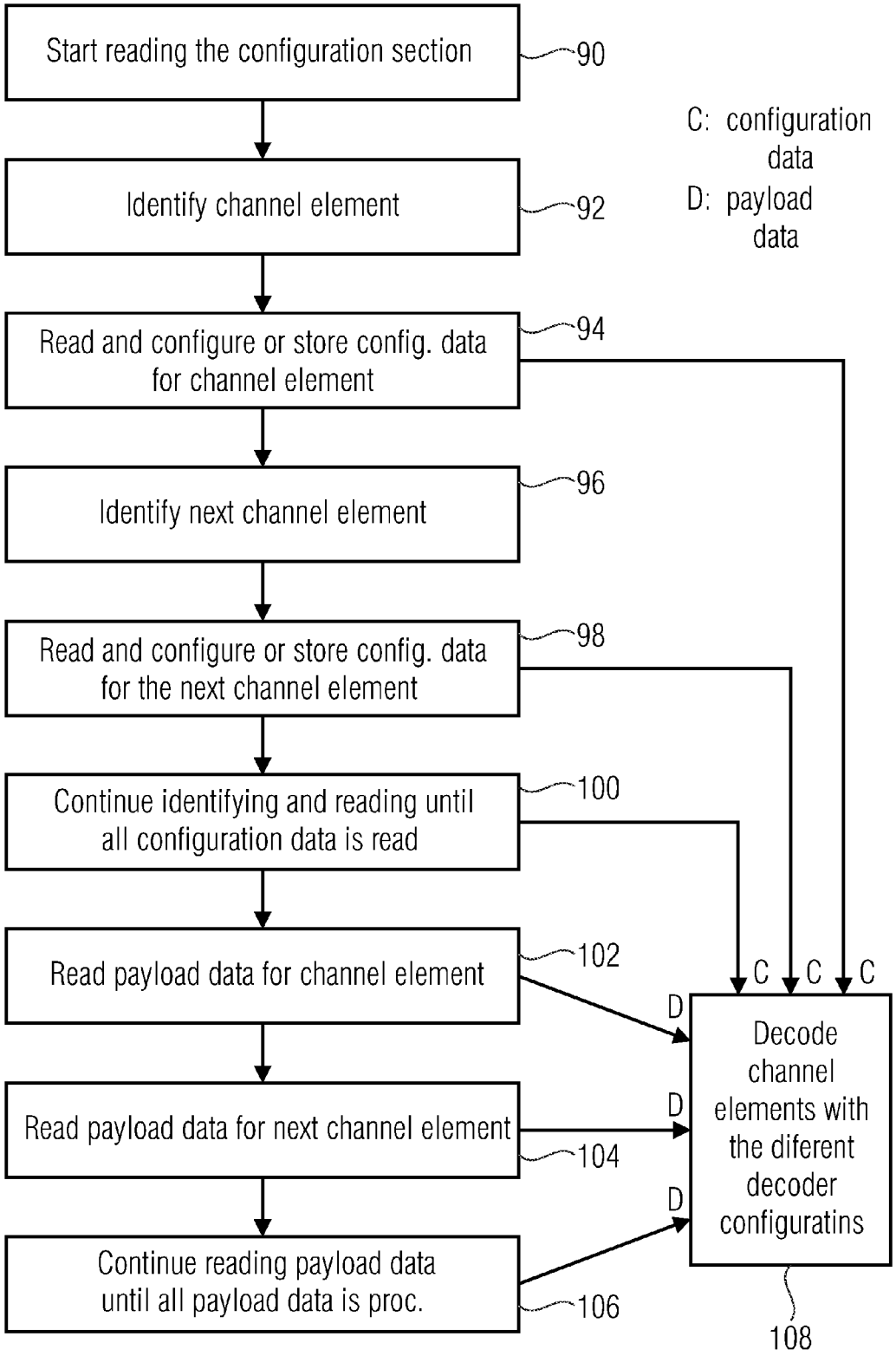
FIG. 9 illustrates an implementation of the decoder of FIG. 1 in a flowchart form.
Figure 10A:
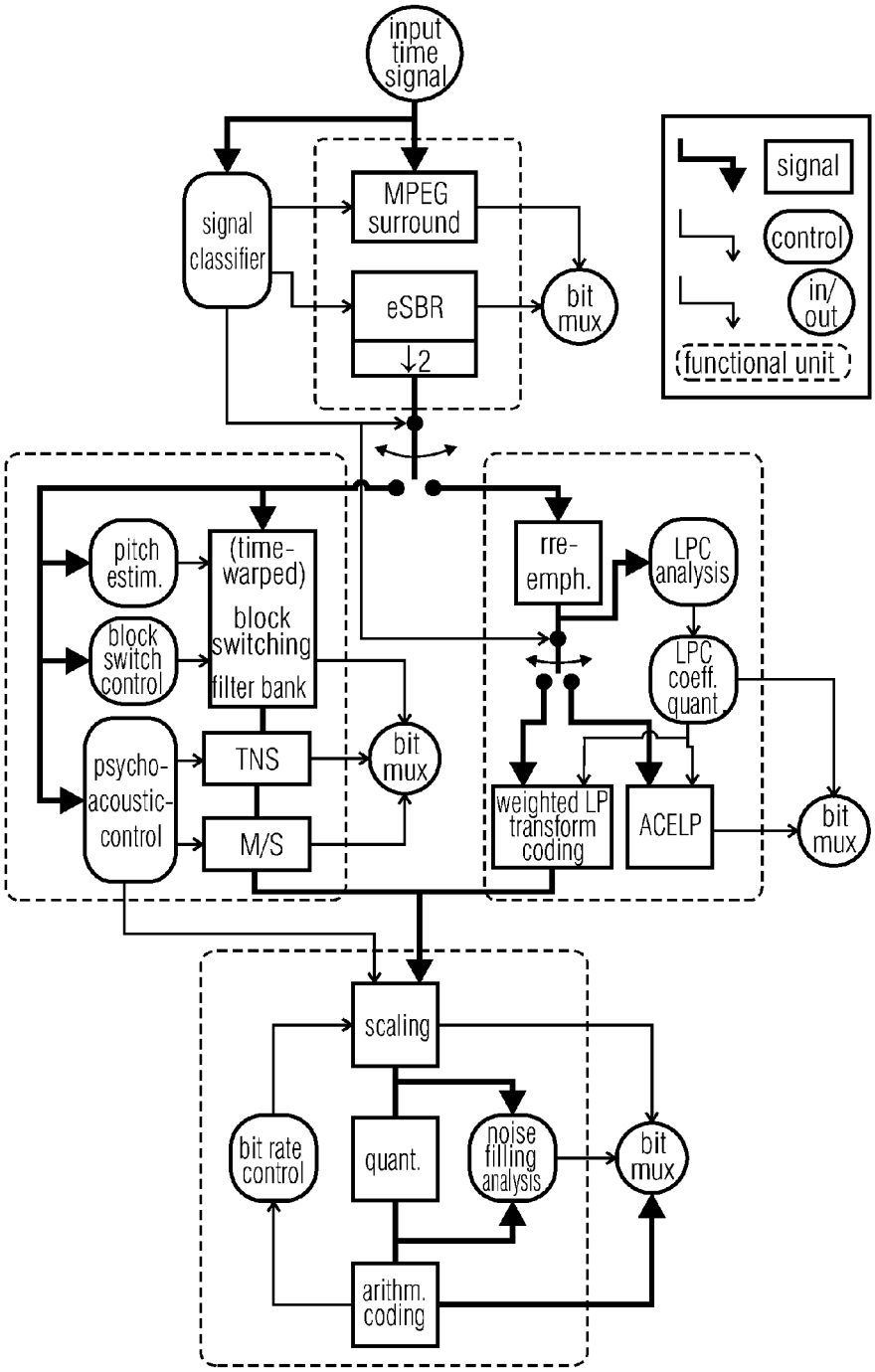
FIG 10A (PRIOR ART)
FIG. 10*a* illustrates the block diagram of the USAC encoder.
Figure 10B:
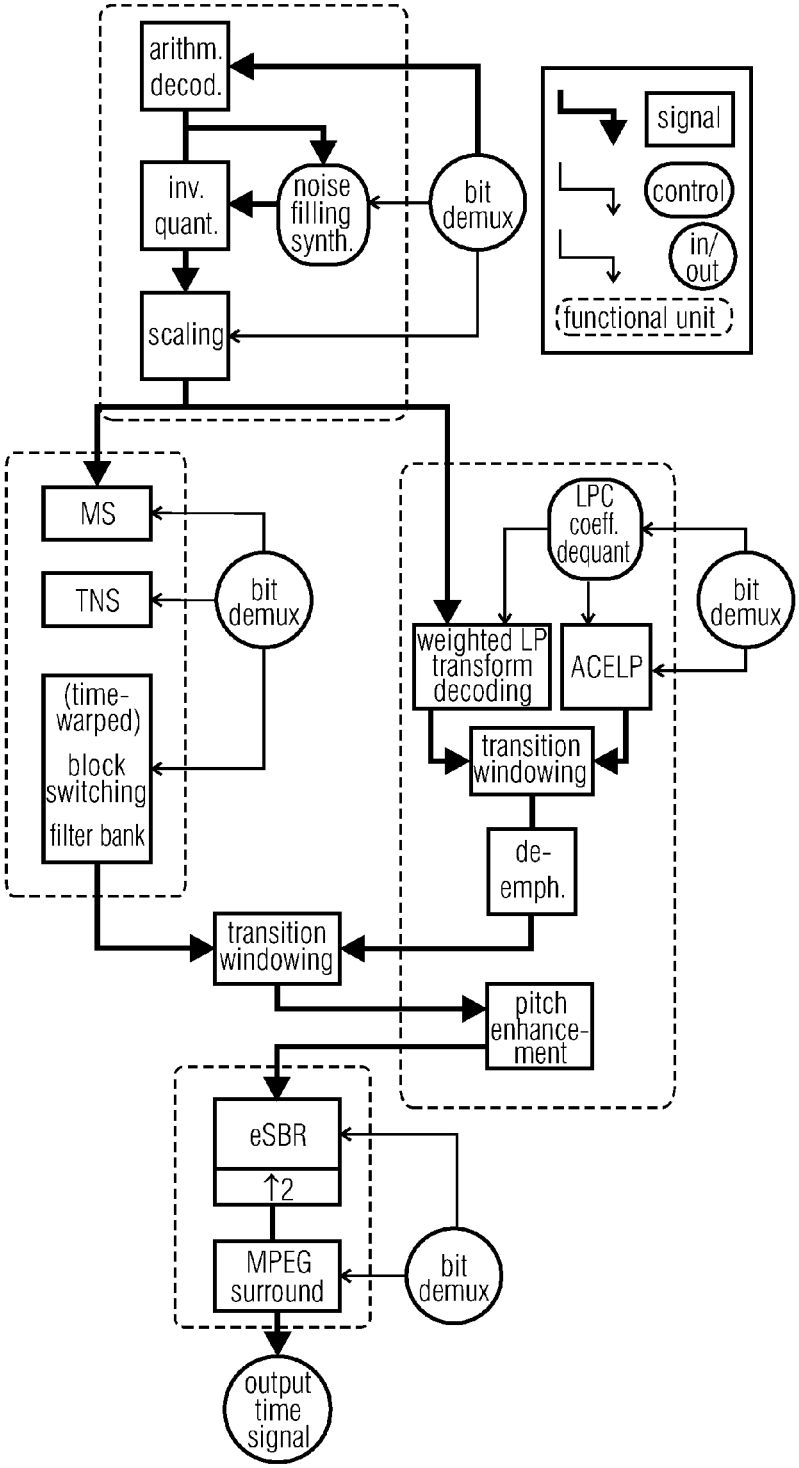
FIG 10B (PRIOR ART)
FIG. 10*b* illustrates the block diagram of the USAC decoder.

FIG. 9 illustrates an implementation of the method for performing decoding an encoded audio signal in accordance with an embodiment of the present invention.

In step 90, the data stream reader 12 starts reading the configuration section 50 of FIG. 5*a*. Then, based on the channel element identification in the corresponding configuration data block 50*c*, the channel element is identified as indicated in step 92. In step 94 the configuration data for this identified channel element is read and used for actually configuring the decoder or for storing to be used later for configuring the decoder when the channel element is later processed. This is outlined in step 94.

In step 96, the next channel element is identified using the element type identifier of the second configuration data in portion 50*d* of FIG. 5*b*. This is indicated in step 96 of FIG. 9. Then, in step 98, the configuration data is read and either used to configure the actually decoder or decoder instance or is read in order to alternatively store the configuration data for the time when the payload for this channel element is to be decoded.

Then, in step 100 it is looped over the whole configuration data, i.e., the identification of the channel element and the reading of the configuration data for the channel element is continued until all configuration data is read.

Then, in steps 102, 104, 106 the payload data for each channel elements are read and are finally decoded in step 108 using the configuration data C, where the payload data is indicated by D. The result of the step 108 are the data output by, for example, blocks 16*a* to 16*d* which can then, for example, be directly sent out to loudspeakers or which are to be synchronized, amplified, further processed or digital/analog converted to be finally sent to the corresponding loudspeakers.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

The encoded audio signal can be transmitted via a wireline or wireless transmission medium or can be stored on a machine readable carrier or on a non-transitory storage medium.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Audio decoder configured for decoding an encoded audio signal, the encoded audio signal comprising first payload data for a first channel element and second payload data for a second channel element in a payload section of a data stream and first decoder configuration data for the first channel element and second decoder configuration data for the second channel element in a configuration section of the data stream, comprising:

a data stream reader configured for reading the first decoder configuration data for the first channel element and the second decoder configuration data for the second channel element in the configuration section and configured for reading the first payload data for the first channel element and the second payload data for the second channel element in the payload section;

a configurable decoder configured for decoding the first payload data for the first channel element and the second payload data for the second channel element; and a configuration controller configured for configuring the configurable decoder, wherein the configurable decoder is configured in accordance with the first decoder configuration data when decoding the first payload data for the first channel element and in accordance with the second decoder configuration data when decoding the second payload data for the second channel element, wherein the first channel element is a single channel element comprising the first payload data for a first output channel, and wherein the second channel element is a channel pair element comprising the second payload data for a second output channel and a third output channel, wherein the configurable decoder is arranged for generating the first output channel when decoding the first payload data for the first channel element using the first decoder configuration data and for generating the second output channel and the third output channel using the second decoder configuration data, when decoding the second payload data for the second channel element, and wherein the audio decoder is configured for outputting the first output channel derived using the first decoder configuration data, the second output channel and the third output channel derived using the second decoder configuration data for a simultaneous output via three different audio output channels, or wherein the first channel element is a first channel pair element comprising the first payload data for a first output channel and a second output channel and wherein the second channel element is a second channel pair element comprising the second payload data for a third output channel and a fourth output channel, wherein the configurable decoder is configured for generating the first output channel and the second output channel when decoding the first payload data for the first channel element using the first decoder configuration data and for generating the third output channel and the fourth output channel when decoding the second payload data for the second channel element using the second decoder configuration data, and wherein the audio decoder is configured for outputting the first output channel and the second output channel derived using the first decoder configuration data, and the third output channel and the fourth output channel derived using the second decoder configuration data for a simultaneous output via four different audio output channels.

2. Audio decoder of claim 1, wherein the first output channel is a center channel and wherein the second output channel is a left channel or a left surround channel and the third output channel is a right channel or a right surround channel.

3. Audio decoder in accordance with claim 1, wherein the first output channel is a left channel, the second output channel is a right channel, the third output channel is a left surround channel and the fourth output channel is a right surround channel.

4. Audio decoder in accordance with claim 1, wherein the encoded audio signal additionally comprises, in the configuration section of the data stream, a general configuration section comprising general configuration information for the first channel element and the second channel element and wherein the configuration controller is arranged to configure the configurable decoder for the first channel element and for the second channel element with the general configuration information from the general configuration section.

5. Audio decoder in accordance with claim 1, wherein the first configuration section is different from the second configuration section, and wherein the configuration controller is arranged to configure the configurable decoder into a second configuration when decoding the second payload data for the second channel element and to configure the configurable decoder into a first configuration when decoding the first payload data for the first channel element, wherein the second configuration is different from the first configuration.

6. Audio decoder in accordance with claim 1, wherein the first decoder configuration data and the second decoder configuration data comprise information on a stereo decoding tool, a core decoding tool or an SBR (Spectral Band Replication) decoding tool, and wherein the configurable decoder comprises the SBR decoding tool, the core decoding tool or the stereo decoding tool.

7. Audio decoder in accordance with claim 1, wherein the payload section comprises a sequence of frames, each frame of the sequence of frames comprising the first channel element and the second channel element, wherein the first decoder configuration data for the first channel element and the second decoder configuration data for the second channel element are associated to the sequence of frames, wherein the configuration controller is configured to configure the configurable decoder for each of the frames of the sequence of frames so that the first channel element in each frame is decoded using the first decoder configuration data and the second channel element in each frame is decoded using the second decoder configuration data.

8. Audio decoder in accordance with claim 1, wherein the data stream is a serial data stream and the configuration section comprises the first decoder configuration data for the first channel element and the second decoder configuration data for the second channel element in an order, and wherein the payload section comprises the first payload data for the first channel element and the second payload data for the second channel elements in the same order.

9. Audio decoder in accordance with claim 1, wherein the configuration section comprises a first channel element identification followed by the first decoder configuration data and a second channel element identification followed by the second decoder configuration data, wherein the data stream reader is arranged to loop over all elements by sequentially parsing the first channel element identification and subsequently reading the first decoder configuration data for the first channel element and subsequently parsing the second channel element identification and subsequently reading the second decoder configuration data for the second channel element.

10. Audio decoder in accordance with claim 1, wherein the configurable decoder comprises a plurality of parallel decoder instances, wherein the configuration controller is arranged to configure a first decoder instance of the plurality of parallel decoder instances using the first decoder configuration data, and to configure a second decoder instance of the plurality of parallel decoder instances using the second decoder configuration data, and wherein the data stream reader is arranged for forwarding the first payload data for the first channel element to the first decoder instance and to forward the second payload data for the second channel element to the second decoder instance.

11. Audio decoder in accordance with claim 10, wherein the payload section comprises a sequence of payload frames, a payload frame comprising the first configuration data for the first channel element and the second configuration data for the second channel element, and wherein the data stream reader is configured to forward the first payload data for the first channel element from a currently processed payload frame only to the first decoder instance configured by the first configuration data for the first channel element and to forward the second payload data for the second channel element from the currently processed payload frame only to the second decoder instance configured by the second configuration data for the second channel element.

12. Method of decoding an encoded audio signal, the encoded audio signal comprising first payload data for a first channel element and second payload data for a second channel element in a payload section of a data stream and first decoder configuration data for the first channel element and second decoder configuration data for the second channel element in a configuration section of the data stream, comprising:

reading the first configuration data for the first channel element and the second configuration data for the second channel element in the configuration section and reading the first payload data for the first channel element and the second payload data for the second channel element in the payload section;

decoding the first payload data for the first channel elements and the second payload data for the second channel element by a configurable decoder; and configuring the configurable decoder so that the configurable decoder is configured in accordance with the first decoder configuration data when decoding the payload data for the first channel element and in accordance with the second decoder configuration data when decoding the second payload data for the second channel element, wherein the first channel element is a single channel element comprising the first payload data for a first output channel, and wherein the second channel element is a channel pair element comprising the second payload data for a second output channel and a third output channel, wherein the configurable decoder is arranged for generating the first output channel when decoding the first payload data for the first channel element using the first decoder configuration data and for generating the second output channel and the third output channel when decoding the second payload data for the second channel element using the second decoder configuration data, and wherein the decoding comprises outputting the first output channel derived using the first decoder configuration data, the second output channel and the third output channel derived using the second decoder configuration data for a simultaneous output via three different audio output channels, or wherein the first channel element is a first channel pair element comprising the first payload data for a first output channel and a second output channel and wherein the second channel element is a second channel pair element comprising the second payload data for a third output channel and a fourth output channel, wherein the configurable decoder is configured for generating the first output channel and the second output channel when decoding the first payload data for the first channel element using the first decoder configuration data and for generating the third output channel and the fourth output channel when decoding the second payload data for the second channel element using the second decoder configuration data, and wherein the decoding comprises outputting the first output channel and the second output channel derived using the first decoder configuration data, and the third output channel and the fourth output channel derived using the second decoder configuration data for a simultaneous output via four different audio output channels.

13. Audio encoder for encoding a multi-channel audio signal, comprising:

a configuration configured for generating first configuration data for a first channel element and second configuration data for a second channel element;

a configurable encoder configured for encoding the multi-channel audio signal to acquire first payload data for the first channel element using the first configuration data and for encoding the multi-channel audio signal to acquire second payload data for the second channel element using the second configuration data; and a data stream generator configured for generating a data stream representing an encoded multi-channel audio signal, the data stream comprising a configuration section comprising the first configuration data and the second configuration data and a payload section comprising the first payload data for the first channel element and the second payload data for the second channel element, wherein the multi-channel audio signal comprises a first input channel, a second input channel and a third input channel, wherein the first channel element is a single channel element comprising the first payload data for the first input channel, and wherein the second channel element is a channel pair element comprising the second payload data for the second input channel and the third input channel, wherein the configurable encoder is arranged for generating the first payload data for the single channel element when encoding the first channel using the first configuration data and for generating the second payload data for the channel pair element when encoding the second input channel and the third input channel using the second configuration data, or wherein the multi-channel audio signal comprises a first input channel, a second input channel, a third input channel, and a fourth input channel, wherein the first channel element is a first channel pair element comprising the first payload data for the first input channel and the second input channel and wherein the second channel element is a second channel pair element comprising the second payload data for the third input channel and the fourth input channel, wherein the configurable encoder is configured for generating the first payload data for the first channel pair element when encoding the first channel and the second channel using the first configuration data and for generating the second payload data for the second channel pair element when encoding the third input channel and the fourth input channel using the second configuration data.

14. Method of encoding a multi-channel audio signal, comprising:

generating first configuration data for a first channel element and second configuration data for a second channel element;

encoding the multi-channel audio signal by a configurable encoder to acquire first payload data for the first channel element using the first configuration data and encoding the multi-channel audio signal to acquire second payload data for the second channel element using the second configuration data; and generating a data stream representing an encoded multi-channel audio signal, the data stream comprising a configuration section comprising the first configuration data and the second configuration data and a payload section comprising the first payload data for first channel element and the second payload data for the second channel element, wherein the multi-channel audio signal comprises a first input channel, a second input channel and a third input channel, wherein the first channel element is a single channel element comprising the first payload data for the first input channel, and wherein the second channel element is a channel pair element comprising the second payload data for the second input channel and the third input channel, wherein the configurable encoder is arranged for generating the first payload data for the single channel element when encoding the first channel using the first configuration data and for generating the second payload data for the channel pair element when encoding the second input channel and the third input channel using the second configuration data, or wherein the multi-channel audio signal comprises a first input channel, a second input channel, a third input channel, and a fourth input channel, wherein the first channel element is a first channel pair element comprising the first payload data for the first input channel and the second input channel and wherein the second channel element is a second channel pair element comprising the second payload data for the third input channel and the fourth input channel, wherein the configurable encoder is configured for generating the first payload data for the first channel pair element when encoding the first channel and the second channel using the first configuration data and for generating the second payload data for the second channel pair element when encoding the third input channel and the fourth input channel using the second configuration data.

15. A non-transitory computer readable medium comprising a computer program for performing, when running on a computer, the method of claim 12.

16. A non-transitory computer readable medium comprising a computer program for performing, when running on a computer, the method of claim 14.

17. Audio encoder of claim 13, wherein the first input channel is a center channel and wherein the second input channel is a left channel or a left surround channel and the third input channel is a right channel or a right surround channel.

18. Audio encoder in accordance with claim 13, wherein the first input channel is a left channel, the second input channel is a right channel, the third input channel is a left surround channel and the fourth input channel is a right surround channel.

* * * * *